US010582810B2

(12) United States Patent
Slothower et al.

(10) Patent No.: US 10,582,810 B2
(45) **Date of Patent: *Mar. 10, 2020**

(54) SHOWER ENCLOSURE SYSTEM

(71) Applicant: Kohler Co., Kohler, WI (US)

(72) Inventors: Erich D. Slothower, Mill Valley, CA (US); Mary J. Reid, Sheboygan, WI (US); Clayton C. Garrels, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/838,830

(22) Filed: Dec. 12, 2017

(65) Prior Publication Data

US 2018/0098670 A1 Apr. 12, 2018

Related U.S. Application Data

(63) Continuation of application No. 14/205,179, filed on Mar. 11, 2014, now Pat. No. 9,848,741.
(Continued)

(51) Int. Cl.
*A47K 3/28* (2006.01)
*A47K 3/30* (2006.01)
(Continued)

(52) U.S. Cl.
CPC ..... *A47K 3/283* (2013.01); *A47K 3/30* (2013.01); *A47K 3/281* (2013.01); *A47K 3/34* (2013.01);
(Continued)

(58) Field of Classification Search
CPC .. A47K 3/28; A47K 3/283–284; A47K 3/286; A47K 3/32–325; E04B 2001/6195; E04B 2/08; E04B 1/6141
See application file for complete search history.

(56) References Cited

U.S. PATENT DOCUMENTS 3,281,172 A 10/1966 Kuehl
3,546,038 A 12/1970 Randall
(Continued)

FOREIGN PATENT DOCUMENTS

CN 201879580 6/2011
CN 202788055 3/2013
(Continued)

OTHER PUBLICATIONS

European Search Report for Application No. 14158972.1, dated Jun. 25, 2014, 7 pages.

*Primary Examiner* — Erin Deery
*Assistant Examiner* — Nicholas A Ros
(74) *Attorney, Agent, or Firm* — Foley & Lardner LLP

(57) ABSTRACT

A joint for a shower enclosure includes a first end member, having a first flange, a rearwardly extending segment spaced apart from the first flange, and a rearwardly open recess defined between the first flange and the rearwardly extending segment. The joint further includes a second end member, having a second flange, a forwardly extending segment spaced apart from the second flange, and a forwardly open recess defined between the second flange and the forwardly extending segment. A gap is defined between the rearwardly extending segment and the second flange when the first end member and the second end member are coupled. The forwardly open recess is configured to receive the rearwardly extending segment and the rearwardly open recess is configured to receive the forwardly extending segment.

22 Claims, 11 Drawing Sheets

Related U.S. Application Data

(60) Provisional application No. 61/776,585, filed on Mar. 11, 2013.

(51) Int. Cl.
*A47K 3/34* (2006.01)
*E04B 1/61* (2006.01)

(52) U.S. Cl.
CPC ..... *E04B 1/6141* (2013.01); *E04B 1/6179* (2013.01); *E04B 2001/6195* (2013.01)

(56) References Cited

U.S. PATENT DOCUMENTS

| | | | | |
|---|---|---|---|---|
| 5,305,567 | A | 4/1994 | Wittler | |
| 5,598,674 | A | 2/1997 | Lay | |
| 6,662,503 | B2 | 12/2003 | Cowell | |
| 8,037,556 | B2 * | 10/2011 | Lock ..... | A47K 3/284 4/596 |
| 9,848,741 | B2 * | 12/2017 | Slothower ..... | A47K 3/283 |
| 2003/0188379 | A1 | 10/2003 | Cowell et al. | |
| 2008/0074741 | A1 | 3/2008 | Bartley | |

FOREIGN PATENT DOCUMENTS

| | | | |
|---|---|---|---|
| CN | 203430082 | | 2/2014 |
| DE | 202009002906 | U1 | 4/2010 |
| EP | 2225986 | A1 | 9/2010 |
| EP | 2491837 | A1 | 8/2012 |
| WO | WO 2006/000783 | A1 | 1/2006 |

* cited by examiner

SHOWER ENCLOSURE SYSTEM

CROSS-REFERENCE TO RELATED APPLICATIONS

This application is a Continuation of U.S. patent application Ser. No. 14/205,179, filed Mar. 11, 2014, which claims the benefit of U.S. Provisional Patent Application No. 61/776,585, filed Mar. 11, 2013. The entire disclosures of each of the aforementioned applications are incorporated herein by reference.

BACKGROUND

Installation of custom shower enclosures is typically very labor intensive, especially for larger sizes of showers. For example, in addition to installation of required plumbing, tiled shower enclosures may require fitting and coupling a backer board to the studs or other structure of a home, fitting and coupling a membrane to the backer board, fitting and coupling individual tiles to the backer board and/or membrane, and applying grout between the tiles. Furthermore, with added complexity due to the structure of a home (e.g., structures being out of square, plumb or level), desired functional aspects of the shower enclosure (e.g., seats, shelves, alcoves, lighting, number of water inlets, steam, doors etc.), and desired aesthetics (e.g., tile design, material, etc.), comes added labor and cost. Various prefabricated shower enclosures are currently available, which require less installation labor, but offer limited options as to color and aesthetic design, functional features, and size.

SUMMARY

According to an exemplary embodiment, a shower enclosure comprises a plurality of prefabricated panels that are arranged to at least partially surround a space for bathing. At least one of the panels is a layered structure having a first layer, a second layer, and a third layer. The first layer forms an interior surface of the shower enclosure exposed to the space for bathing. The third layer is arranged between the first layer and the second layer, and is coupled to the first layer and the second layer. The layered structure is a sandwich structured composite comprising the first layer, second layer, and third layer.

According to an exemplary embodiment, a shower enclosure comprises a plurality of panels that are arranged to at least partially surround a space for bathing. The plurality of panels includes a first panel and a second panel adjacent to the first panel. The first panel includes a first elongated end member coupled to an end thereof. The second panel includes a second elongated end member coupled to an end thereof. The first end member and the second end member interfit at first sides thereof to couple the first panel to the second panel and a form a joint therebetween.

DETAILED DESCRIPTION

According to various exemplary embodiments described herein, a shower enclosure includes a plurality of prefabricated panels that are configured for easy installation and significant reduction in associated installation labor, while providing greater flexibility in color and aesthetic design, functional features, and size. For example, a user may order a shower enclosure according to conventional sizes (e.g., corresponding to typical shower receptor or bathtub sizes and standard ceiling heights) or custom sizes (e.g., depending on size and layout constraints of the location for the enclosure), desired aesthetics (e.g., material, color, patterns, images, etc.), and functional features (e.g., outlet and control locations, door or access location and type, lighting type and location, venting and/or steam location, and accessories, such as shelves or baskets that may be easily coupled to the panels). The custom ordered shower enclosure is then provided by the manufacturer, for example, as a kit for easy installation. The kit may include pre-manufactured panels (e.g., with proper size, cutouts, pre-installed valves, outlets, and/or lighting, etc.) and may include necessary hardware for installation of the shower enclosure. Furthermore, the panels may be provided in sizes that are small enough to easily transport through a home, yet large enough such that few panels are required (e.g., four panels, one for each side wall and two for a rear wall of the enclosure).

Figure 1:
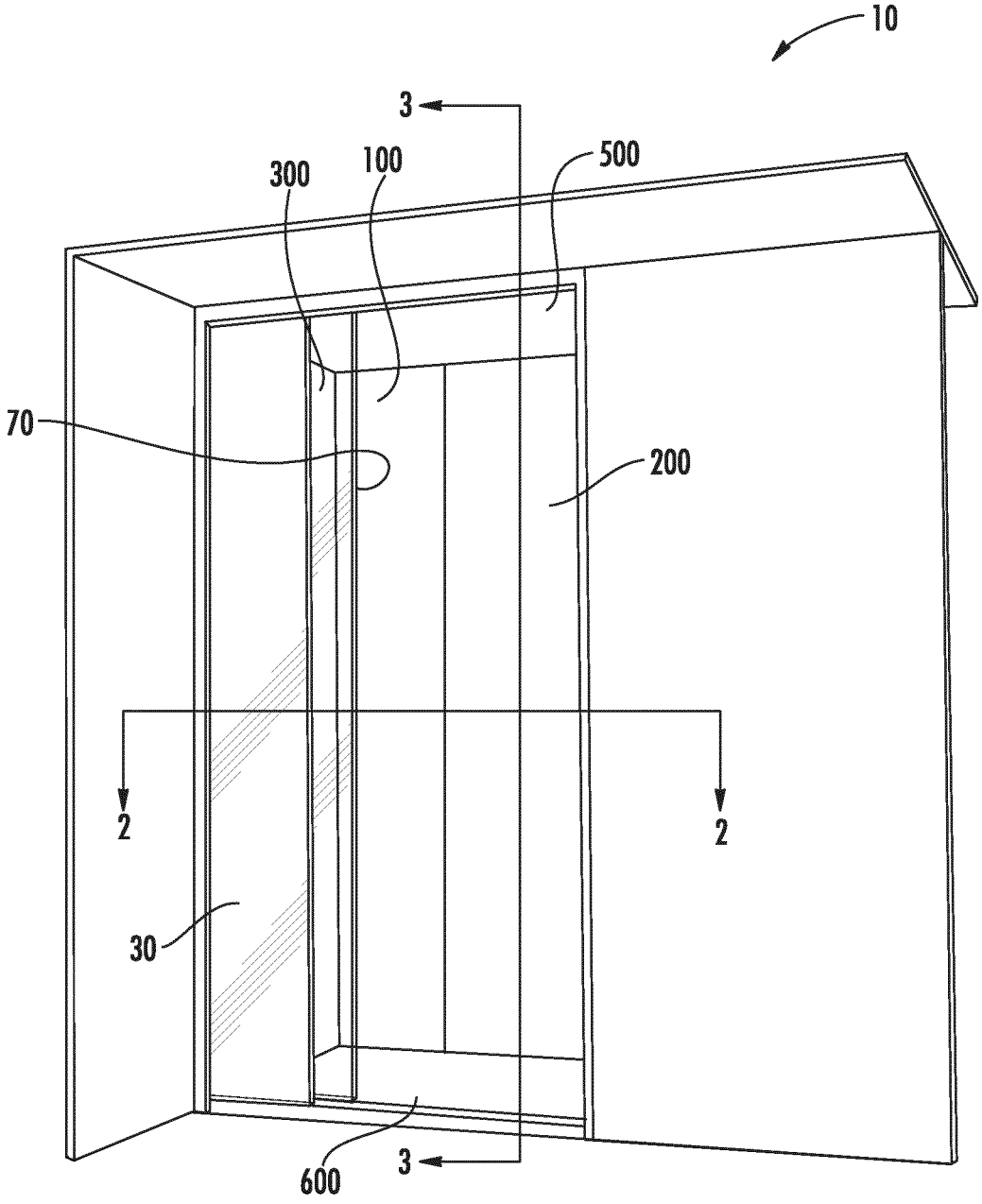
FIG. 1 is a perspective view of a shower enclosure according to an exemplary embodiment.
Figure 2:
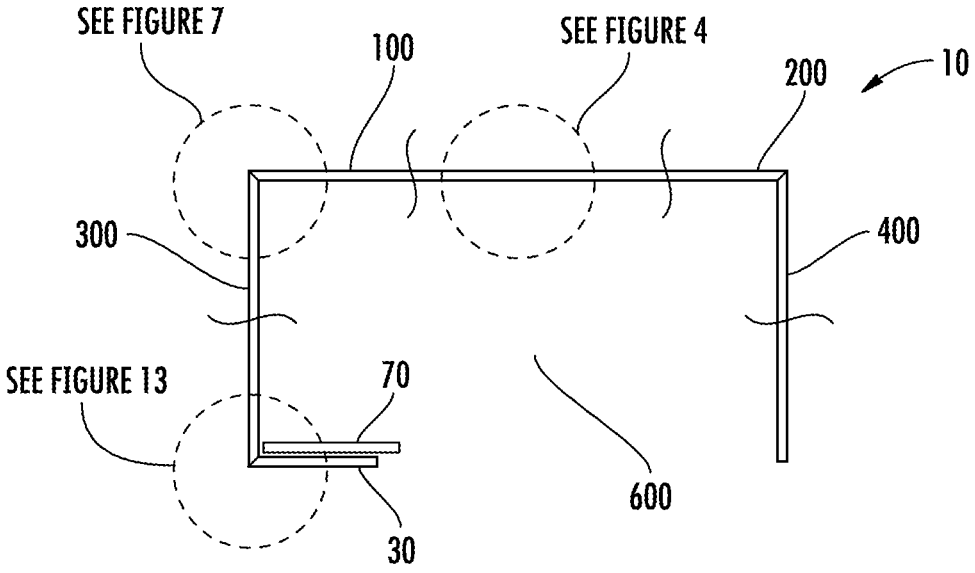
FIG. 2 is a schematic, cross-sectional view of the shower enclosure according to FIG. 1 taken along Line 2-2.
Figure 3:
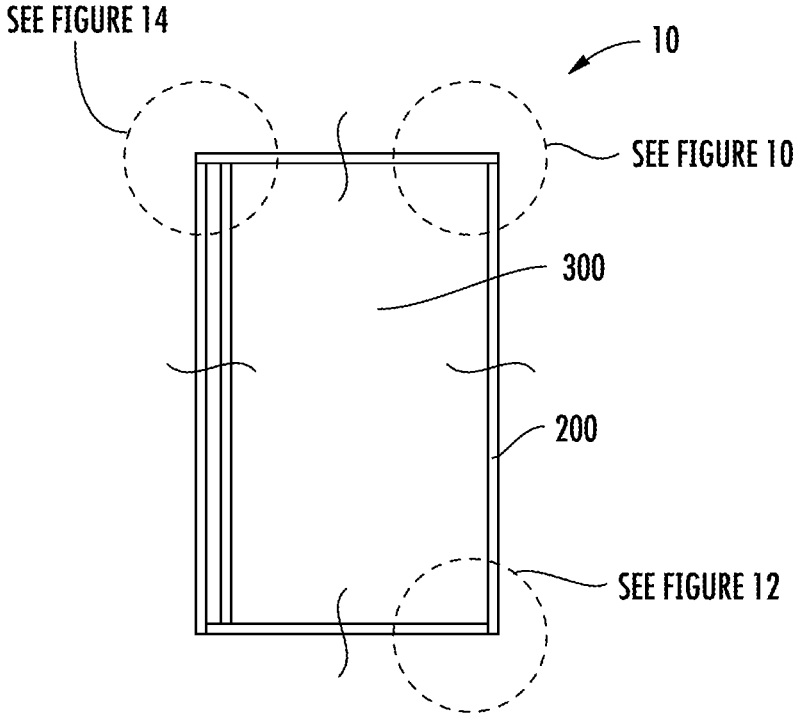
FIG. 3 is a schematic, cross-sectional view of the shower enclosure according to FIG. 1 taken along Line 3-3.

Referring generally to FIGS. 1-3, according to an exemplary embodiment, a bathing or shower enclosure or surround 10 includes a plurality of panels (e.g., planar members, structures, section, etc.) that may act as walls, a ceiling, and/or a floor of the enclosure 10. Each of the panels includes end members (e.g., extrusions, elements, etc.) at one or more (e.g., four) of its ends (e.g., edges) that are configured to interfit (e.g., interlock, engage, couple to, etc.) an end member of an adjacent panel. In this manner, the plurality of panels are configured to couple to each other to cooperatively define the shower enclosure and form the structure thereof. It should be noted that the terms "enclosure" and "surround" include structures or systems that either fully or partially surround a space for bathing.

For example, according to an exemplary embodiment, the shower enclosure 10 may include a first rear wall 100 and a second rear wall 200 that are configured to provide generally coplanar, generally vertical rear surfaces of the shower enclosure 10. By providing the rear vertical, interior surface(s) of the shower enclosure with multiple wall panels, greater widths of shower enclosures may be provided (e.g., approximately 60 inches), while utilizing panels that are of sizes (e.g., approximately 30 inches wide) that are easy to handle for installation and transport through a house. A first side panel 300 and a second side panel 400 are arranged generally opposite each other, each side panel 300, 400 being adjacent to one of the rear wall panels 100, 200 and providing a generally vertical side surface of the shower enclosure 10, which is generally perpendicular to its adjacent rear panel. A ceiling panel 500 and/or floor panel 600 may also be provided, which provide generally horizontal surfaces that are generally perpendicular to each of the wall panels 100, 200, 300, 400, or the wall panels may be configured for use with a shower receptor, bathtub, or other lower structure and/or with conventional ceilings or other upper structure. According to other exemplary embodiments, the panels may be configured in other manners including, for example, use of more or fewer panels for each surface and providing panels at different relative angles to each other.

As used herein, the directional terms of forward, rearward, inward, outward, etc. and variations thereof, are generally made in reference to an interior of the shower enclosure 10 (i.e., forward/inward being toward the interior and rearward/outward being away from the interior) or with reference to an entry of the shower (i.e., forward/outward being in a direction prior to the entry or of exiting the shower enclosure, and rearward being in a direction after entry or of entry into the shower enclosure). Alternatively, the directional terms inner, outer, and variations thereof may be used with reference to a particular component thereof (e.g., outer portions may be disposed outward of inner portions of a particular a component).

Figure 4:
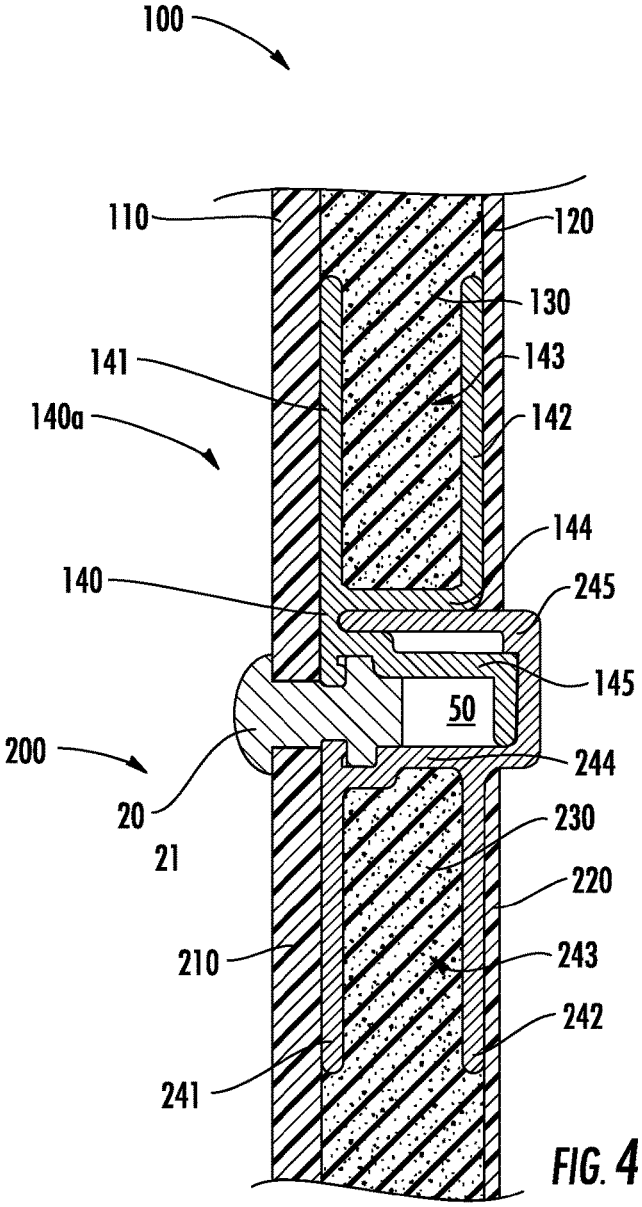
FIG. 4 is a magnified, cross-sectional view of two intersecting rear wall panels of the shower enclosure shown in FIG. 2.

Referring generally to FIG. 4, according to an exemplary embodiment, one or more of the panels 100 (and/or 200, 300, etc.) is a layered structure (e.g., sandwich structured composite) having a first (e.g., outer) layer 110, a second outer layer 120, and a third or inner (e.g., core) layer 130. The third layer 130 is arranged between and is coupled to the first layer 110 and the second layer 120 to provide the panel 100 with bending rigidity (i.e., similar to an I-beam). The first outer layer 110 is exposed to a bather to form an interior (e.g., forward) surface of the shower enclosure 10) and is configured for water shedding (e.g., material characteristics, surface finish, etc.). For example, the first layer 110 may be formed from a relatively thin, generally rigid or stiff material such as glass, acrylic, metal, wood, resin, or any other suitable material with or without decorative features (e.g., etching, back painting, coloring, printed or embedded images, etc.). The second outer layer 120 generally is not exposed to the bather or water and, therefore, may be configured without aesthetic or water shedding properties. For example, the second layer 120 may be a relatively thin, generally rigid or stiff material, such as glass, acrylic, metal, resin, wood, or any other suitable material. The third or core layer 130 is positioned behind the first outer layer so as not to be exposed to the bather or water and, therefore, may not have aesthetically or water shedding properties. For example, the third or core layer may be a relatively thick material (compared to layers 110, 120) and may be formed of a foam, wood, honeycomb polymer or metal, or any other suitable material. In embodiments where transparent or translucent materials are used for the first layer 110, the third layer 130 may be configured with desirable aesthetic characteristics. According to other exemplary embodiments, the layered structure of each panel may be configured in other manners including, but not limited to, a different number of layers (e.g., more layers), different materials or combinations of materials, etc. Advantageously, by utilizing a sandwich structured composite, each panel may be premanufactured (i.e., manufactured prior to installation, as opposed to in place formation, such as tiling) with a rigid and relatively light weight structure (e.g., due to the layered configuration) for easy movement, placement, and installation within a home.

According to an exemplary embodiment, each panel 100 includes an elongated end member (e.g., 140, 240, 340, etc.) at one or more edges (e.g., ends, sides, etc.) thereof. Generally speaking, each end member includes a first end (e.g., side, region, portion, etc.), such as first end 140*a*, configured to be coupled the panel 100 (i.e., to each of the layers 110, 120, 130) and an end (e.g., side, region, portion, etc.), such as second end 140*b*, that is configured to interfit with an end member of an adjacent panel or another structure. Advantageously, by providing interfitting end members as described herein, a shower enclosure 10 may be quickly assembled into a generally rigid structure without the use of conventional fasteners to couple wall panels to each other.

It should be noted that, for each end member variation (e.g., 140, 240, 340, etc.), like reference numerals in the hundreds are generally used to refer to similar features based on function and/or structure (e.g., first ends 140*a*, 240*a*,

340*a* of end members 140, 240, 340, respectively, are configured to couple to the layers of respective panels).

According to an exemplary embodiment, each end member (e.g., 140, 240, etc.) may be an extruded aluminum component. According to other exemplary embodiments, each end member may be made according to other methods (e.g., molding, injection molding, etc.), different materials (e.g., alloys, plastics, resins, etc.), and the like.

According to an exemplary embodiment, the first end 140*a* of each member 140 includes a first segment 141 (e.g., flange, extension, portion, etc.) and a second segment 142 (e.g., flange, extension, portion, etc.) spaced apart from the first segment 141 to define a space 143 therebetween. For example, a third segment 144 may extend between the first segment 141 and the second segment 142 (i.e., being generally opposed or perpendicular thereto), such that the first, second, and third segments 141, 142, 144 generally form a "U" shape. The first outer layer 110 overlaps (e.g., covers, extends over or in front of, has an adjacent or abutting face with, etc.) the first segment 141, so as to generally cover the segment 141 from view. The first outer layer 110 may also be coupled directly to an outer surface of the first segment 141, such as with an adhesive or other suitable method (e.g., curing thereto, etc.). The second outer layer 120 may overlap the second segment 142 (or abut an end of the segment) and may also be coupled directly to an outer surface or end second segment 142, such as with an adhesive or other suitable method (e.g., curing thereto, etc.). The third layer or core 130 is arranged between the first outer layer 110 and second outer layer 120, as well as the space 143 between the first segment 141 and second segment 142 of the end member 140. The third layer 130 may be coupled to the first layer 110 and second layer 120 and/or the end member 140 for example with adhesives or other suitable method (e.g., curing thereto).

According to an exemplary embodiment, a pair of end members is configured to provide a joint (e.g., seam, connection, interface, coupling, etc.) between two adjacent panels. For example, as discussed in further detail below, end member pairs may form an intermediate joint between adjacent, generally coplanar, vertical wall panels, may form a corner joint between adjacent, angularly arranged (e.g., generally perpendicular), vertical wall panels, and may form corner joints between generally horizontal panels (e.g., ceiling, floor) and generally vertical wall panels.

Referring generally to FIGS. 4-12, according to an exemplary embodiment, the second end 140*b* of each end member 140 opposite the first end 140*a* is configured to couple the end member 140 to an adjacent panel or other structure. Depending on the location and type of joint, the second end 140*b* of each adjacent panel has a different configuration. Generally speaking, at their second ends (e.g., 140*b*), each end member (e.g., 140), includes a male member (e.g., 145) and female receptacle (e.g., 146), the male member (e.g., 145) being configured to be inserted or received by a complementary female receptacle (e.g., 246) of an adjacent end member (e.g., 240) and the female receptacle (e.g., 146) being configured to receive a male member (e.g., 245) of the adjacent end member (e.g., 240). More particularly, each pair of interfitting end members includes a forward end member (e.g., 140) having a rearwardly extending segment (e.g., 145) and a rearwardly open recess (e.g., 146) and includes a rearward end member (e.g., 240) having a forwardly extending segment (e.g., 245) configured to be inserted into the rearwardly open recess (e.g., 146) of the forward end member (e.g., 140) and a forwardly open recess (e.g., 246) configured to receive the rearwardly extending segment (e.g., 145) of the forward end member (e.g., 140).

Figure 5:
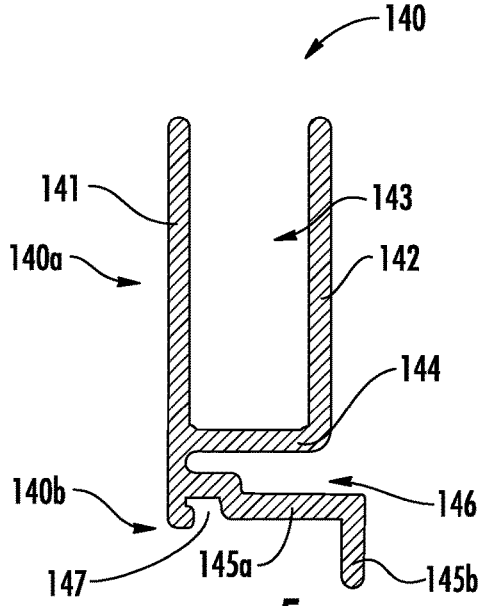
FIG. 5 is a cross-sectional view of a forward intermediate end member according to the exemplary embodiment shown in FIG. 4.
Figure 6:
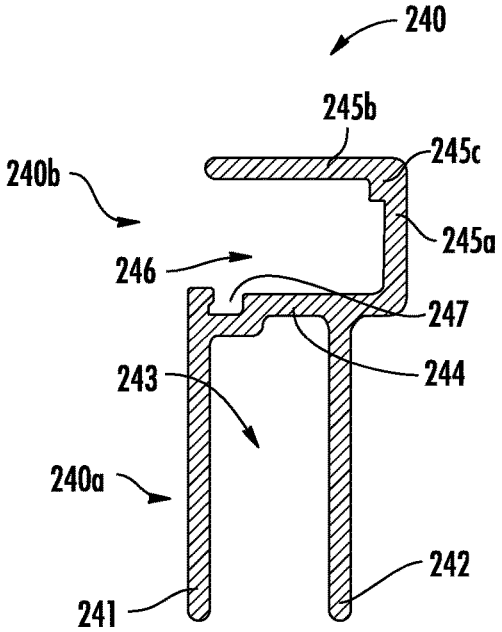
FIG. 6 is a cross-sectional view of a rearward intermediate end member according to the exemplary embodiment shown in FIG. 4.

Referring to FIGS. 4-6, according to an exemplary embodiment, end members 140, 240 are configured to couple adjacent rear, generally coplanar, generally vertical wall panels 100, 200 to each other. For example, a first rear wall panel 100 includes a forward intermediate end member 140 at a generally vertical edge thereof to be positioned at in an intermediate region of the rear wall. The second rear wall panel 200 includes a rearward intermediate end member 240 at a generally vertical edge thereof to be positioned at an intermediate region of the rear wall. The first ends 140*a*, 240*a* of the forward and rearward intermediate end members 140, 240 are configured to couple to the panels 100, 200 (e.g., layers), as described previously. The second ends 140*b*, 240*b* of the end members 140, 240 are configured to interfit (e.g., interlock, engage, couple, etc.) with each other to form a joint (e.g., seam, coupling, connection, interface, etc.) therebetween, such that the panels 100, 200 are substantially coplanar.

According to an exemplary embodiment, the forward intermediate end member 140, at its second end 140*b*, includes a rearwardly projecting segment 145 (e.g., male member, protrusion, extension, portion, etc.) that extends substantially perpendicular from the first segment 141. The rearwardly projecting segment 145 is spaced apart from the third flange 144, which also extends substantially perpendicular from the first flange 141, so as to define a rearwardly open female receptacle 146 therebetween.

The rearward intermediate end member 240, at its second end 240*b*, includes a forwardly projecting segment 245 (e.g., male member, protrusion, extension, portion, etc.) that extends substantially perpendicular relative to the first segment 241. The forwardly projecting segment 245 is spaced apart laterally from the third segment 244, such that a forwardly open female receptacle or recess 246 is defined therebetween. The forwardly projecting segment 245 is generally parallel with at least a portion of the third segment 244.

Additionally, the respective widths of the segments or male members 145, 245 and corresponding recesses 246, 146, respectively of the other end member, may also be cooperatively configured for tight interfitting or engagement therebetween (i.e., the recesses 146, 246 are slightly larger, generally the same size, or slightly smaller than the corresponding male members 245, 145, respectively, and are configured to deform (e.g., bend, stretch, elastically or otherwise) to receive at least a portion of the corresponding male member therein). Furthermore, the respective lengths of the male members 145, 245 and depths of the corresponding recesses 246, 146, respectively, may also be cooperatively configured such that the first segments 141, 241 (or first outer layers 110, 210) are generally coplanar with each other, for example, by having an end of the forwardly extending segment 245 engage a rear facing surface of the rearwardly open recess 146 and/or by having an end of the rearwardly extending segment 145 engage a forward facing surface of the forwardly open recess 246.

Configured in these manners, the rearwardly open recess 146 of the forward intermediate end member 140 is configured to receive the forwardly projecting segment 245 of the rearward intermediate end member 240, and the forwardly open recess 247 of the rearward intermediate end member 240 is configured to receive the rearwardly projecting segment 146 of the forward intermediate end member 140, so as to couple the first rear panel 100 to the second rear panel 200.

According to an exemplary embodiment, as best shown in FIG. 4, the forward intermediate end member 140 and rearward intermediate end member 240 are configured to define a space or gap 50 therebetween, such as to receive a compliant member 20 (e.g., gasket, seal, etc.) therebetween. For example, forward intermediate end member 140 may include a rearwardly projecting segment 145 that is generally L-shaped, having a first leg 145*a* (e.g., portion, extension, etc.) extending substantially perpendicular rearward from the first segment 141 and a second leg 145*b* (e.g., extension, portion, etc.) extending substantially perpendicular from the first leg 145*a* (i.e., substantially parallel to the first segment 141, or a portion thereof). The rearward intermediate end member 240 may include a forwardly projecting segment 245 having a first leg 245*a* (e.g., portion, extension, etc.) that extends substantially perpendicular from the third segment 244 (i.e., substantially parallel with the first segment 241, or a portion thereof) and a second leg 245*b* that extends substantially perpendicular forward from the first leg 245*b* (e.g., substantially parallel with the third segment 244, or a portion thereof). The widths of the second leg 145*b* of the rearwardly projecting member 145 (of the forward intermediate end member 140) and the width of the forwardly open recess 246 of the rearward intermediate end member 240 are configured such that the second leg 145*b* extends between and/or tightly engages (e.g., being slightly wider, approximately the same length, or slightly shorter) opposing faces of the segment 244 and second leg 245*b* or a portion thereof (e.g., step or ledge 245*c*). Configured in this manner, the gap 50 has a width approximately equal to the length of the second leg 145*b* of the forward intermediate end member 140 less the thickness of the first leg 145*a*.

Furthermore, with a portion of the rearwardly extending segment 145 of the forward intermediate end member 140 engaging surfaces of the segment 244 and second leg 245*b* of the rearward intermediate end member 240, the intermediate end members 140, 240 cooperatively engage each other to prevent movement (e.g., translation, pivoting, bending, etc.) between each other and the panels 100, 200 to which they are coupled. Still further, the forwardly projecting segment 245 and/or rearwardly projecting segment 145 may be arranged at least in part rearward of the second segments 142, 242 of the respective end members 140, 240, for example, to increase torsional rigidity of the connection formed between the corner end members 140, 240.

According to an exemplary embodiment, the end members 140, 240 may each include a channel 147, 247 configured to receive a projection 21 (e.g., projection, flange, etc.) of the gasket 20, so as to retain the gasket 20 at least partially in the gap 50 between the forward and rearward intermediate end members 140, 240. The gasket 20 functions to prevent water from entering the gap and/or to prevent movement (e.g., translation, pivoting, bending, etc.) between panels 100, 200 and the forward and rearward intermediate end members 140, 240. The gasket 20 may also include surfaces that are configured to tightly press or seal against outer surfaces of the first layers 110, 210 of the wall panels 100, 200, respectively. According to other exemplary embodiments, the gasket 20 may be configured in other manners including, for example, having a different exposed profile (e.g., non-convex, other curvature, flat, etc.), being flush with or recessed relative to the outer layers 110, 210 of the panels 100, 200, respectively, only engaging edges of the outer layers 110, 210 of the panels 100, 200 as opposed to forward surfaces thereof, etc.

Figure 4A:
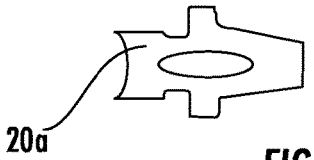
FIG. 4*a* is a cross-sectional cross-sectional view of a gasket according to another exemplary embodiment.

According to another exemplary embodiment, as shown in FIG. 4*a*, the gasket (e.g., gasket 20*a*) has a concave exterior profile (e.g., to resemble a caulk seal), and/or includes a central hollow portion to, for example, allow the gasket to be elastically compressed inwardly for insertion into the gap 50 between end members or between an end member and a base member).

According to an exemplary embodiment, the process of assembly or coupling of the first rear panel 100 to the second rear panel 200 includes positioning the forward intermediate end member 140 in front of the rearward intermediate end member 240, and moving the panel 100 rearward such that the rearward projecting segment 145 is received within the forwardly open recess 246 and the forward projecting segment 245 is received within the rearwardly open recess 146 (e.g., until one or both of the rearward and/or forward projecting segments 145, 245 engage an opposing surface of the complementary recess 246, 146, respectively, or until the forward surfaces of the panels 100, 200 are generally flush or coplanar). The gasket 20 is then inserted into the gap 50, such that the protrusions 21 are received in the channels 147, 247 of the forward and rearward intermediate end members 140, 240 respectively.

According to other exemplary embodiments, end members 140, 240 may be configured in other manners to provide a connection between generally coplanar wall panels 100, 200 including, but not limited to, other angular relationships between different segments of the end members (e.g., non-perpendicular), different number of corresponding male members and female receptacles (e.g., one set, three sets, or no sets with only overlapping flanges), and/or use of mechanical fasteners (e.g., clips, tabs, threaded fasteners, etc.) to couple end members to each other and/or to a wall structure (e.g., wall stud).

Figure 7:
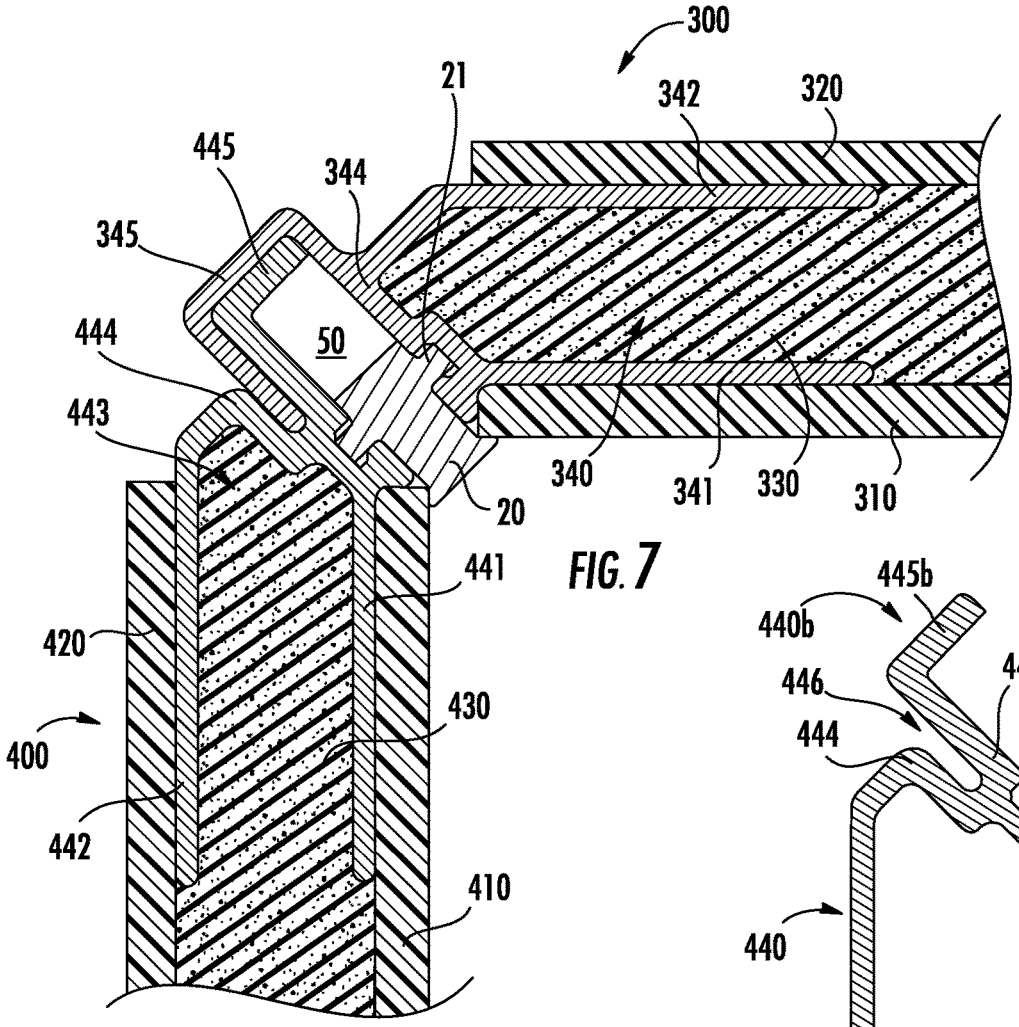
FIG. 7 is a magnified, cross-sectional view of two intersecting wall panels at a corner of the shower enclosure from FIG. 2.
Figure 9:
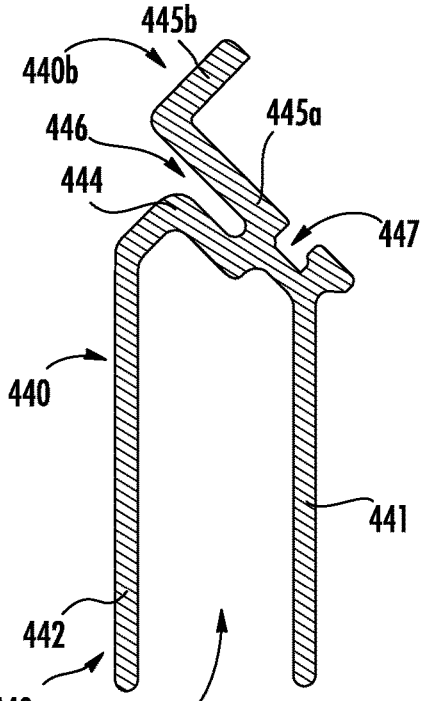
FIG. 9 is a cross-sectional view of a forward corner end member according to the exemplary embodiment shown in FIG. 7.
Figure 8:
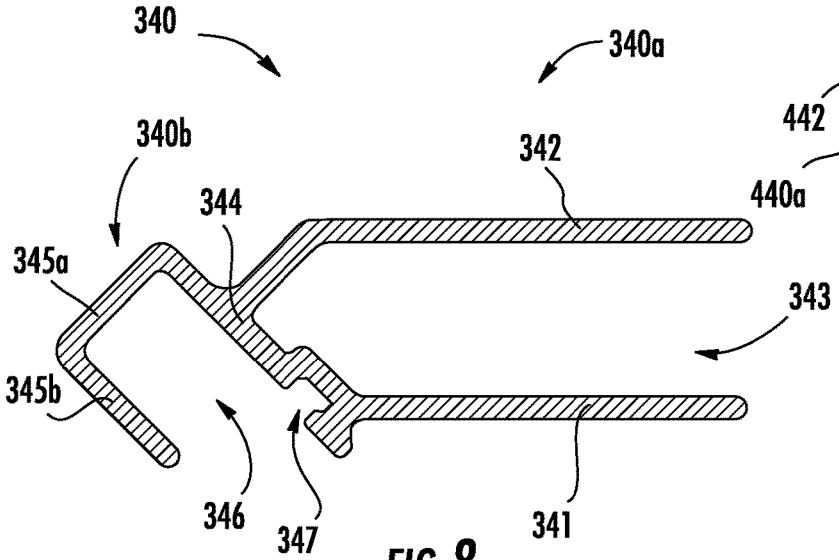
FIG. 8 is a cross-sectional view of a rearward corner end member according to the exemplary embodiment shown in FIG. 7.

Referring to FIGS. 7-9, according to an exemplary embodiment, corner end members 340, 440 are configured to couple a rear, generally vertical wall panel 100 to a side, generally vertical wall panel 300 at a corner (e.g., ~90 degree angle between forward surfaces thereof). For example, the first rear wall panel 100 includes a rearward corner end member 340, and the side panel 300 includes a forward corner end member 440. Each of the corner end members 340, 440 include first ends 340*a*, 440*a* configured as described above for coupling to the respective layers of the panels. The second ends 340*b*, 440*b* are configured to interfit (e.g., interlock, couple, etc.) with each other to form a joint (e.g., seam, coupling, connection, interface, etc.) therebetween, such that the panels 100, 300 are at approximately a 90 degree angle relative to each other.

According to an exemplary embodiment, the forward corner end member 440, at its second end 440*b*, includes a rearwardly projecting segment 445 (e.g., male member, protrusion, extension, portion, etc.) that extends at an angle (e.g., approximately 45 degrees) rearward of the first segment 441. For example, the rearwardly projecting segment 445 may extend from a third segment 444, the third segment 444 interconnecting the first segment 441 and second segment 442 at a spaced apart distance to define the cavity 443 therebetween. The rearwardly projecting segment 445 is spaced apart from the third segment 444 (e.g., generally parallel with a portion thereof), so as to define a rearwardly open female receptacle 446 therebetween.

According to an exemplary embodiment, the rearward corner end member 340, at its second end 340*b*, includes a forwardly projecting segment 345 (e.g., male member, protrusion, extension, portion, etc.) that extends forward at an angle relative to the relative to the first segment 341 (e.g., approximately 45 degrees). For example, the forwardly projecting segment 345 may extend from a third segment

344 that interconnects the first segment 341 and second segment 342, the third segment 344 spacing apart the first segment 341 and second segment 342 to form a cavity 343 therebetween for receiving the third layer 330 of the panel therebetween. The forwardly projecting segment 345 is spaced apart from the third segment 344 (e.g., generally parallel with a portion thereof), so as to define a forwardly open female receptacle 346 therebetween.

Additionally, the respective widths of the segments or male members 345, 445 and corresponding recesses 446, 346, respectively of the other end member, may also be cooperatively configured for tight interfitting or engagement therebetween (i.e., the recesses 346, 446 are slightly larger, generally the same size, or slightly smaller than the corresponding male members 445, 345, respectively, and configured to deform (e.g., bend, stretch, elastically or otherwise) to receive at least a portion of the corresponding male member therein). Furthermore, the respective lengths of the male members 345, 445 and depths of the corresponding recesses 446, 345, respectively, may also be cooperatively configured such that the forwardly extending segment 445 engages a rear facing surface of the rearwardly open recess 346 and/or an end of the rearwardly extending segment 445 engages a forward facing surface of the forwardly open recess 346.

Configured in these manners, the rearwardly open recess 446 of the forward corner end member 440 is configured to receive the forwardly projecting segment 345 of the rearward corner end member 340, and the forwardly open recess 346 of the rearward corner end member 340 is configured to receive the rearwardly projecting segment 446 of the forward corner end member 440, so as to couple the first side panel 300 to the rear panel 100.

According to an exemplary embodiment, the forward corner end member 440 and rearward corner end member 340 are configured to define a space or gap 50*a* therebetween, such as to receive a gasket 20*a* therebetween. For example, forward corner end member 440 may include a rearwardly projecting segment 445 that is generally L-shaped, having a first leg 445*a* (e.g., portion, extension, etc.), or portion thereof, extending generally rearward at an angle (e.g., approximately 45 degrees) relative to the first segment 441 and a second leg 445*b* (e.g., extension, portion, etc.), or portion thereof, extending substantially perpendicular from the first leg 445*a* (e.g., extending forward at approximately a 45 degree angle relative to the first segment 441). The rearward corner end member 340 may include a forwardly projecting segment 345 having a first leg 345*a* (e.g., portion, extension, etc.), or portion thereof, extending generally forward at an angle (e.g., approximately 45 degrees) relative to the first segment 341 and a second leg 345*b* that extends substantially perpendicular forward from the first leg 345*a* (e.g., extending forward at approximately 45 degrees relative to another portion of the first segment 341). The widths of the second leg 445*b* of the rearwardly projecting member 445 (of the forward corner end member 440) and the width of the forwardly open recess 346 of the rearward corner end member 340 are configured such that the second leg 445*b* extends between and/or tightly engages (e.g., being slightly wider, approximately the same length, or slightly shorter) opposing faces of the segment 344 and second leg 345*b* or a portion thereof (e.g., step of ledge 345*c*). Configured in this manner, the gap 50 has a width approximately equal to the width of the second leg 345*b* of the forward corner end member 340 less the thickness of the first leg 345*a*.

Furthermore, with a portion of the rearwardly extending segment 445 of the forward corner member 440 engaging surfaces of the segment 344 and second leg 345*b* of the rearward corner member 340, the corner end members 340, 440 cooperatively engage each other to prevent movement (e.g., translation, pivoting, bending, etc.) between each other and the panels 100, 300, respectively, to which they are coupled. Still further, the forwardly projecting segment 345 and/or rearwardly projecting segment 445 may be arranged at least in part rearward of the second segments 342, 442 of the respective end members 340, 440, for example, to increase torsional rigidity of the connection formed between the corner end members 340, 440.

According to an exemplary embodiment, the corner end members 340, 440 may each include a channel 347, 447, respectively, configured to receive a projection 21*a* of the gasket 20*a*, so as to retain the gasket 20*a* at least partially in the gap 50*a* between the rearward and forward corner end members 340, 440. The gasket 20*a* functions to prevent water from entering the gap 50 and/or to prevent movement (e.g., translation, pivoting, bending, etc.) between the corner end members 340, 440. The gasket 20*a* may also include surfaces that are configured to tightly press or seal against outer surfaces of the first layers 110, 310 of the wall panels 100, 300, respectively. According to other exemplary embodiments, the gasket 20*a* may be configured in other manners including, for example, having a different exposed profile (e.g., curved, concave, convex, etc.), being recessed relative to the outer layers 310, 410 of the panels 300, 400, respectively, only engaging edges of the outer layers 310, 410 as opposed to forward surfaces thereof, etc.

According to an exemplary embodiment, assembly or coupling of the rear panel 100 to the corner panel 300 includes positioning the forward corner end member 440 in front of the rearward corner end member 340, and moving the side panel 300 rearward such that the rearward projecting segment 445 is received within the forwardly open recess 346 and the forward projecting segment 345 is received within the rearwardly open recess 446. The compliant member 20*a* is then inserted into the gap 50*a*, such that the protrusions 21*a* are received in the channels 347, 447 of the rearward and forward corner end members 340, 440 respectively.

According to other exemplary embodiments, end members 340, 440 may be configured in other manners to provide a connection between generally perpendicular wall panels 100, 300 including, but not limited to, other angular relationships between different segments of the end members (e.g., greater or less than 45 degrees, or non-perpendicular), different number of corresponding male members and female receptacles (e.g., one set, three sets, or no sets with only overlapping flanges), and/or use of mechanical fasteners (e.g., clips, tabs, threaded fasteners, etc.) to couple end members to each other and/or to a wall structure (e.g., wall stud).

Figure 10:
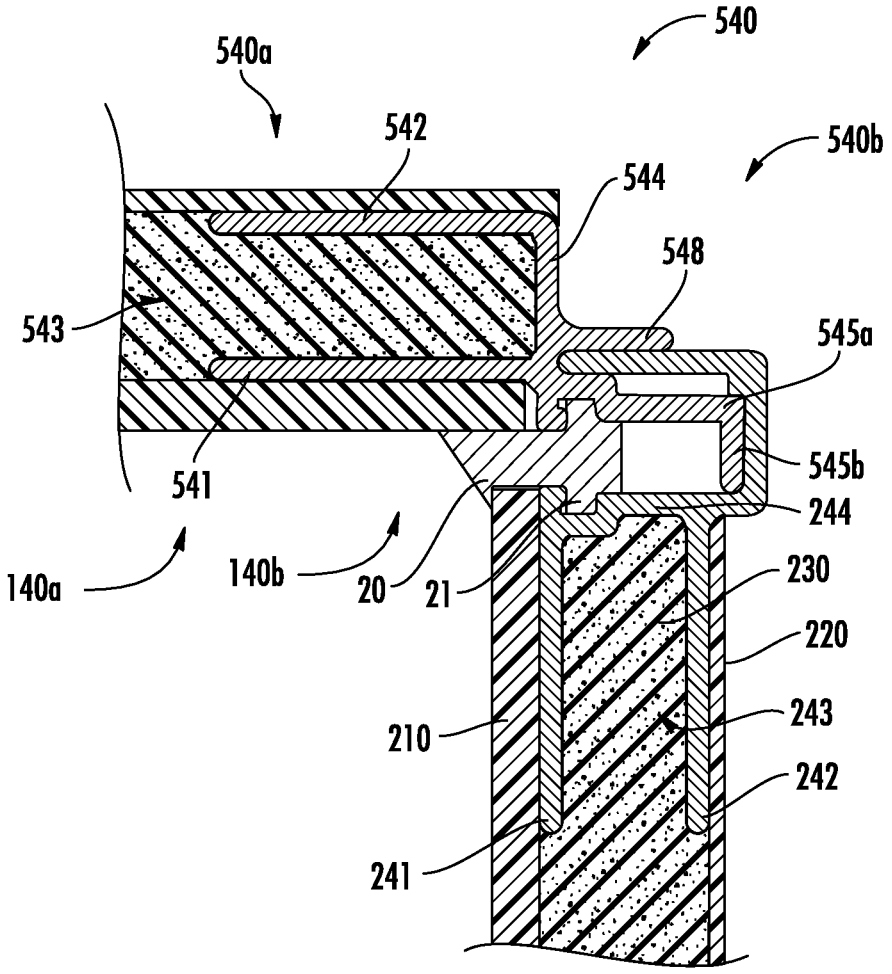
FIG. 10 is a magnified, cross-sectional view of an intersecting wall panel and ceiling panel of the shower enclosure from FIG. 3.
Figure 11:
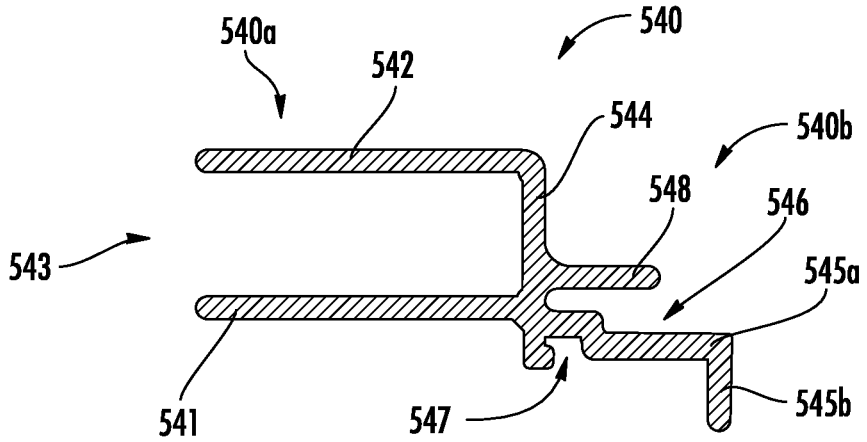
FIG. 11 is a cross-sectional view of a ceiling end member according to the exemplary embodiment shown in FIG. 10.

Referring to FIGS. 10-11, according to an exemplary embodiment, end members 240, 540 are configured to couple the wall panels (e.g., rear panel 100, rear panel 200, or side panel 300) to an upper or ceiling panel 500 (e.g., forming an approximately 90 degree corner therebetween). The upper end member 240 is configured substantially similar to the rearward intermediate member 240 to include a first end 240*a* coupled to respective layers of the side or rear panel 100 and a second end 240*b* configured to interfit (e.g., interlock, couple, etc.) with the ceiling end member 540.

According to an exemplary embodiment, the ceiling end member 540 similarly includes a first end 540*a* configured to couple to the respective layers of the ceiling panel 500, as described previously, and a second end 540*b* configured to interfit with the second end 240*b* of the upper end member 240.

According to an exemplary embodiment, the second end 540*b* of the ceiling end member 540 includes a rearwardly projecting segment 545 (e.g., male member, protrusion, extension, portion, etc.) that extends rearward in a substantially parallel direction relative to the first segment 541. For example, the rearwardly projecting segment 545 may extend from a position slightly below the first segment 541. A second rearwardly projecting segment 548 also extends in a substantially parallel direction relative of the first segment 541, for example, from a position slightly above the first segment 541, so as to define a rearwardly open receptacle 546 therebetween (e.g., at approximately the height of the first segment 541).

Additionally, the respective widths of the segments or male members 245, 545 and corresponding recesses 546, 246, respectively of the other end member, may also be cooperatively configured for tight interfitting or engagement therebetween (i.e., the recesses 246, 546 are slightly larger, generally the same size, or slightly smaller than the male members and configured to deform (e.g., bend, stretch, elastically or otherwise) to receive at least a portion of the corresponding male member 545, 245, respectively of the other end member, therein). Furthermore, the respective lengths of the male members 245, 545 and depths of the corresponding recess 546, 246 may also be cooperatively configured such that the forwardly extending segment 245 engages a rear facing surface of the rearwardly open recess 546 and/or an end of the rearwardly extending segment 545 engages a forward facing surface of the forwardly open recess 246.

Configured in these manners, the rearwardly open recess 546 of the ceiling end member 540 is configured to receive the forwardly projecting segment 245 of the upper end member 240, and the forwardly open recess 246 of the upper end member 240 is configured to receive the rearwardly projecting segment 546 of the ceiling end member 540, so as to couple the wall panel (e.g., 100, etc.) to the ceiling panel 500.

According to an exemplary embodiment, the ceiling end member 540 and upper end member 240 are configured to define a space or gap 50*b* therebetween, such as to receive a gasket 20*b* therebetween. For example, ceiling end member 540 may include a rearwardly projecting segment 545 having a first leg 545*a* (e.g., portion, extension, etc.) extending generally parallel with the first segment 541 and a second leg 545*b* (e.g., extension, portion, etc.) extending substantially perpendicular from the first leg 545*a* (e.g., generally perpendicular to the first segment 541). The widths of the second leg 545*b* of the rearwardly projecting member 545 (of the ceiling end member 540) and the width of the forwardly open recess 246 of the upper end member 240 are configured such that the second leg 545*b* extends between and/or tightly engages (e.g., being slightly wider, approximately the same length, or slightly shorter) the third opposing faces of the segment 244 and second leg 245*b* or a portion thereof (e.g., step or ledge 245*c*). Configured in this manner, the gap 50*b* has a width approximately equal to the width of the second leg 545*b* of the ceiling end member 540 less the thickness of the first leg 545*a*.

Furthermore, with a portion of the rearwardly extending segment 545 of the ceiling end member 540 engaging surfaces of the segment 244 and second leg 245*b* of the upper end member 240, the upper end member 240 and ceiling end member 540 cooperatively engage each other to prevent movement (e.g., translation, pivoting, bending, etc.) between each other and the panels (e.g., 100) to which they are coupled. Still further, the forwardly projecting segment 245 and/or rearwardly projecting segment 545 may be arranged at least in part rearward of the second segments 242, 542 of the respective end members 240, 540, for example, to increase torsional rigidity of the connection formed between the upper and ceiling end members 240, 540.

According to an exemplary embodiment, the end members 240, 540 may each include a channel 247, 547 configured to receive a projection 21*b* (e.g., projection, flange, etc.) of the gasket 20*b*, so as to retain the gasket 20*b* at least partially in the gap between the ceiling and upper end members 540, 240. The gasket 20*b* functions to prevent water from entering the gap and/or to prevent movement (e.g., translation, pivoting, bending, etc.) between the ceiling and upper end members 540, 240. The gasket 20*b* may also include surfaces that are configured to tightly press or seal against outer surfaces of the first layers 110, 510 of the wall panel (e.g., 100) and ceiling panel 500, respectively. According to other exemplary embodiments, the gasket 20*b* may be configured in other manners including, for example, having a different exposed profile (e.g., concave, convex, other curvature, multi-angled, etc.), being flush with or recessed relative to one or more of the outer layers 210, 510 of the panels 200, 500, respectively, etc.

According to an exemplary embodiment, assembly or coupling of the ceiling panel 500 occurs after assembling the wall panels (e.g., rear panels 100 and 200, and side panels 300) to each other. The ceiling panel 500 is raised, such that the rearward projecting segment 545 is at the height of the forwardly open recesses 246 of the upper end members of the side wall panels for insertion therein. The ceiling panel 500 is then slid, such that the rearward projecting segments 545 are slid within and parallel to side walls and transversely (i.e., perpendicular to) the forwardly open recesses 246 of the upper members 240 of the rear walls for insertion therein.

According to other exemplary embodiments, end members 240, 540 may be configured in other manners to provide a connection between a wall panel (e.g., 100, 200, 300, etc.) and ceiling panel 500 including, but not limited to, other angular relationships between different segments of the end members (e.g., non-perpendicular), different number of corresponding male members and female receptacles (e.g., one set, three sets, or no sets with only overlapping flanges), and/or use of mechanical fasteners (e.g., clips, tabs, threaded fasteners, etc.) to couple end members to each other and/or to a wall structure (e.g., wall stud).

Figure 12:
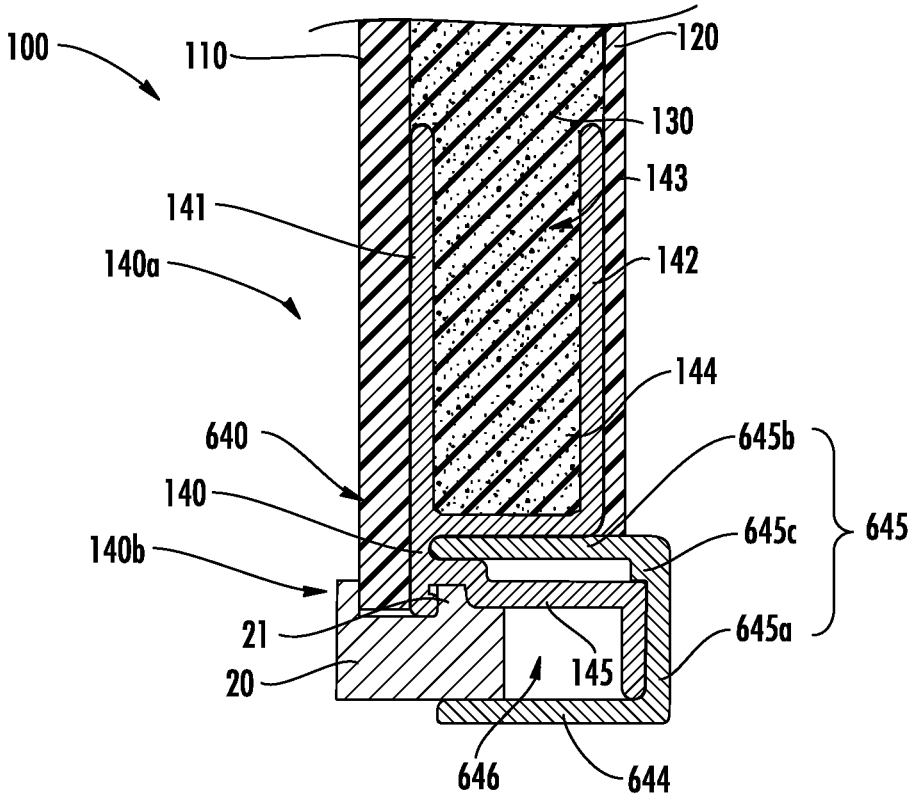
FIG. 12 is a magnified, cross-sectional view of a wall panel and a base member of the shower enclosure from FIG. 3.
Figure 13:
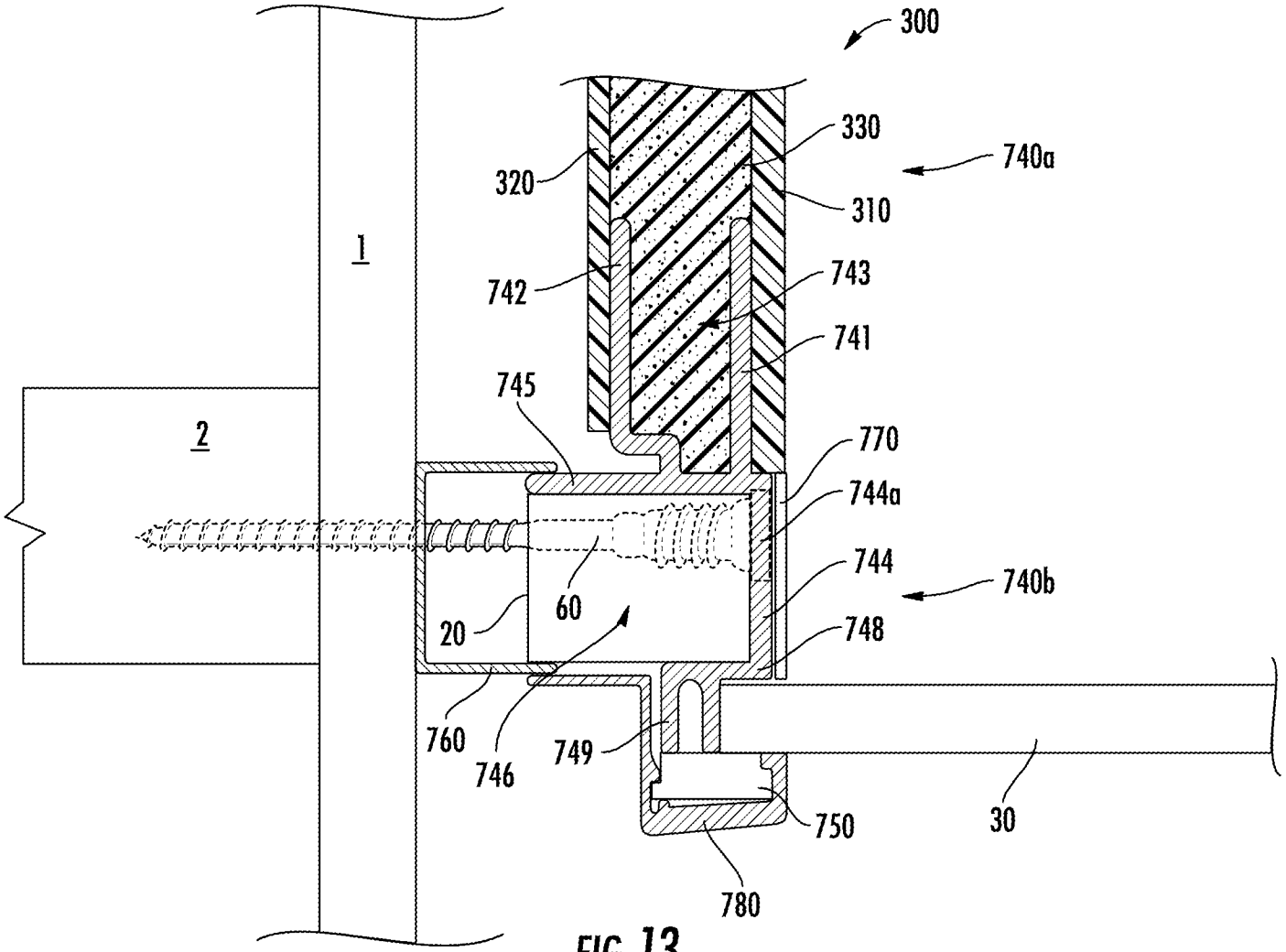
FIG. 13 is a magnified, cross-sectional view of a wall panel and terminating end member of the shower enclosure from FIG. 2.

Referring to FIG. 12, according to an exemplary embodiment, end members 140, 640 are configured to couple the wall panels (e.g., rear panel 100, rear panel 200, or side panel 300) to a base (e.g., shower receptor, bathtub, tray, floor, etc.). The lower end member 140 is configured substantially similar to the forward intermediate rear member 140 described above to include a first end 140*a* coupled to respective layers of the wall panel (e.g., rear panels 100 and 200, or side panels 300, 400) and a second end 140*b* configured to interfit (e.g., interlock, couple, etc.) with the base member 640.

According to an exemplary embodiment, the base member 640 is configured to couple to a base (e.g., by coupling segment 644 or a first leg 645*a* of a second segment 645 with fasteners and/or adhesive to a wall, floor, or other structure). According to another exemplary embodiments, the base member 640 may include a first side configured with flanges or segments (e.g., as described above) for coupling to a base structure.

According to an exemplary embodiment, the base member 640 includes a first (e.g., lower) forwardly projecting segment 644 and a second (e.g., upper) forwardly projecting segment 645 (e.g., male member, protrusion, extension, portion, etc.) that extends in a substantially parallel direction relative to the first forwardly projecting segment 644, so as to define a forwardly open receptacle 646 therebetween. For example, the second forwardly projecting segment 645 may include a first leg 645*a* extending generally perpendicularly upward from the first forwardly projecting segment 644, and a second leg 645*b* extending generally perpendicularly forward from the first leg 645*a*.

Additionally, the respective widths of the segments or male members 145, 645 and corresponding recesses 646, 146, respectively of the end member, may also be cooperatively configured for tight interfitting or engagement therebetween (i.e., the recesses 146, 646 are slightly larger, generally the same size, or slightly smaller than the corresponding male members 645, 145, respectively, and configured to deform (e.g., bend, stretch, elastically or otherwise) to receive at least a portion of the corresponding male member therein). Furthermore, the respective lengths of the male members 145, 645 and depths of the corresponding recess 646, 146, respectively, may also be cooperatively configured such that an end of the forwardly extending segment 645 engages a rear facing surface of the rearwardly open recess 146 and/or an end of the rearwardly extending segment 145 engages a forward facing surface of the forwardly open recess 646.

Configured in these manners, the rearwardly open recess 146 of the lower end member 140 is configured to receive the forwardly projecting segment 645 of the base member 640, and the forwardly open recess 646 of the base member 640 is configured to receive the rearwardly projecting segment 146 of the lower end member 540, so as to couple the wall panel to the base 600.

According to an exemplary embodiment, the base member 640 and lower end member 140 are configured to define a space or gap therebetween (as described above), such as to receive a compliant member (e.g., gasket, seal, etc.) therebetween. For example, lower end member 140 may include a rearwardly projecting segment 145 that is generally L-shaped having a first leg 145*a* (e.g., portion, extension, etc.) extending generally parallel with the first segment 141 and a second leg 145*b* (e.g., extension, portion, etc.) extending substantially perpendicular from the first leg 145*a* (e.g., generally perpendicular to the first segment 141). The widths of the second leg 145*b* of the lower end member 140 and first leg 645*a* of the base member 640 are configured such that the second leg 145*b* engages the lower forwardly projecting segment 644 and second leg 645*b*, or a portion thereof (e.g., step or ledge 645*c*). Configured in this manner, the gap has a width approximately equal to the width of the second leg 145*b* of the lower end member 140.

According to an exemplary embodiment, the lower end member 140 may include a channel 147 configured to receive a projection 21*c* (e.g., protrusion, flange, etc.) of the gasket 20*c*, so as to retain the gasket 20*c* at least partially in the gap between the lower end and base members 140, 640. According to other exemplary embodiments, the base member 640 may also include a channel to receive a projection 21*c* of the gasket 20*c*. The gasket 20*c* functions to prevent water from entering the gap and/or to prevent movement (e.g., translation, pivoting, bending, etc.) between the lower end and base members 140, 640, as well as between the wall panels (e.g., rear panels 100, 200 and side panel 300) and the base 600. The gasket 20*c* may also include a surface that is configured to tightly press or seal against an outer surface of the first layer (e.g., 110) of the wall panel (e.g., 100).

According to an exemplary embodiment, an end or side of the rearwardly projecting segment 145 of the lower end member 140 engages one or more portions of the base member 640 (e.g., first forwardly projecting segment 644, or second forwardly projecting segment 645) to prevent pivoting or bending between the wall panels and the base 600. According to another exemplary embodiment, the second forwardly projecting segment 645 and/or rearward projecting segment 145 are arranged at least in part rearward of the second segment 142 of the lower end member 140 to increase torsional rigidity of the connection formed between the lower end member 140 and the base member 640.

According to an exemplary embodiment, assembly or coupling of each wall panel requires raising the wall panel such that the rearward projecting segment 145 is at the height of the forwardly open recesses 646 of the base member 640 for insertion therein.

According to other exemplary embodiments, the lower end member 140 and base member 640 may be configured in other manners to provide a connection between a wall panel (e.g., 100, 200, 300, etc.) and base including, but not limited to, other angular relationships between different segments of the end members (e.g., non-perpendicular), different number of corresponding male members and female receptacles (e.g., one set, three sets, or no sets with only overlapping flanges), and/or use of mechanical fasteners (e.g., clips, tabs, threaded fasteners, etc.) to couple end members to each other and/or to a wall structure (e.g., wall stud).

Referring to FIGS. 13, 15, 16, and 17B, according to an exemplary embodiment, a side panel (e.g., 300) includes a terminating end member (e.g., 740) at a vertical edge thereof, which is generally opposite the corner end member thereof. The terminating end member 740 includes a first end 740*a*, configured as described previously for interconnecting with the panel 300 (e.g., layers 310, 320, 330) in the manners described previously. At its second end 740*b*, the terminating end member 740 may be configured to positively couple to a separate structure (e.g., a wall structure of a home) and/or a fixed or stationary panel 30.

According to an exemplary embodiment, the terminating end member 740, at its second end 740*b*, defines a recess 746 (e.g., pocket, region, etc.) in which a substrate 25 is disposed for receiving a threaded fastener 60 for coupling the terminating end member 740 to a wall stud 2. The recess is generally defined between a first rearwardly extending flange 745 (e.g., segment, member, etc.), a forward flange 744, and a second rearwardly extending flange 748 that is generally opposite the first rearwardly extending flange 745 and spaced apart therefrom by the forward flange 744.

According to an exemplary embodiment, the first rearwardly extending flange 745 interconnects the first segment 741 and 742 at a spaced apart distance, so as to define the cavity 743 therebetween (e.g., to receive the third layer 330 of the panel 300 therebetween). The rearwardly extending flange 743 extends generally perpendicular rearward of the first segment 741 to a position rearward of the second layer 320 of the panel 300.

According to an exemplary embodiment, the forward flange 744 extends in a direction generally parallel to the first segment 741 and may be positioned forward therefrom (e.g., a distance less than the thickness of the first layer 310 of the panel 300). The forward flange 744 further includes one of more apertures 744*a* (e.g., holes, etc.) at varying heights for receiving the threaded fasteners 60 therein.

According to an exemplary embodiment, the second rearwardly extending flange 748 extends generally perpendicular rearward from the forward flange 744, thereby defining the recess 746 in which the substrate 25 is positioned.

According to an exemplary embodiment, the substrate 25 enables fastening of the terminating end member 740 (and thereby the panel 300) to a structure (e.g., through a drywall 1 (or tile, paneling, other decorative layer or material, etc.) and into a wall stud 2 of a home) with a threaded fastener 60. The substrate 25 is coupled to the terminating end member 740, for example, through the use of adhesives, fasteners (not shown), and/or a mechanical connection (e.g., compression fit) between the substrate 25 and the inner surfaces of the recess 746.

According to an exemplary embodiment, the terminating end member 740 is configured to be mounted (i.e., connected, coupled, etc.) to the wall stud 2 in a substantially vertical (i.e., plumb) orientation toward or away from the wall stud 2. For example, the fastener 60 itself may be specially configured to provided adjustable spacing between the substrate 25 and the wall stud 2 (e.g., as shown, having first and second, spaced-apart sets of threads, the first for engaging the wall stud 2 and the second for engaging the substrate 25). Or, more conventional means may be used, such as positioning shims between the substrate 25 and drywall 1 and/or wall stud 2 before fastening with a conventional threaded fastener.

According to an exemplary embodiment, a wall channel 760 configured to receive a portion of the terminating end member 740 and/or substrate 25 therein, for example, for decorative and/or structural purposes. The wall channel 760 generally includes two forwardly extending, generally parallel flanges 761, 762 that are interconnected by a generally straight, flat rear segment 763. For example, after receiving the terminating end member 740 and substrate 25, a first (i.e., forward) of the flanges 761 is generally positioned adjacent and/or in contact with a forward surface of the substrate 25, and a second (i.e., rear) of the flanges 762 is generally positioned adjacent and/or in contact with the second rearwardly extending flange 745 of the terminating end member 740. Further, the second flange 762 of the channel 760 may be received into a recess 742*a* (e.g., pocket) of the terminating end member 740, which is defined generally between portions of the second segment 742 and the first rearwardly extending flange 745.

According to an exemplary embodiment, the wall channel 760 is configured to be coupled to the home (e.g., drywall 1 and/or wall stud 2), for example, between the generally straight, flat segment 763 and the drywall 1 and/or wall stud 2 with adhesives and/or threaded fasteners. The wall channel 760 may be configured to provide decorative flange (e.g., the first of the forwardly extending flanges 761) configured to cover a gap (e.g., a non-uniform or varying gap arising from a non-straight or out-of-plumb home structure) between the substrate 25 and drywall 2. The wall channel 760 may additionally provide structural rigidity to the terminating end member 740, for example, to prevent movement of the wall panel 300 in a direction generally perpendicular to the fasteners 60 (e.g., generally parallel with the drywall 1).

According to an exemplary embodiment, the terminating end member is configured to receive and/or couple to a fixed (e.g., stationary, non-moveable, etc.) panel 30. The fixed panel 30 may, for example, be a glass (or other translucent, transparent, or decorative material) panel provided at an entry side of the shower enclosure 10 and having water shedding property and appealing aesthetics.

According to an exemplary embodiment, the terminating end member 740 receives the fixed panel 30 in a corner region generally defined by an outer surface of the second rearwardly extending flange 748 and a second forward flange 749 that extends from the second rearwardly extending flange 748 at a generally 90 degree angle (i.e., generally parallel with the first segment 741). The fixed panel 30 is coupled to the terminating end member 740, for example, with an adhesive between a rear surface the fixed panel 30 and the second rearwardly extending flange 748 and/or an edge (or end) surface of the fixed panel 30 and the second forward flange 749. Further, a stop or clamp member 750 may couple to the second forward flange 749 (e.g., with fasteners (now shown) that extend into holes or a channel of the second forward flange 749) to tightly hold (e.g., compress) the fixed panel 30 between the stop member 750 and the second rearwardly extending flange 748.

Figure 21:
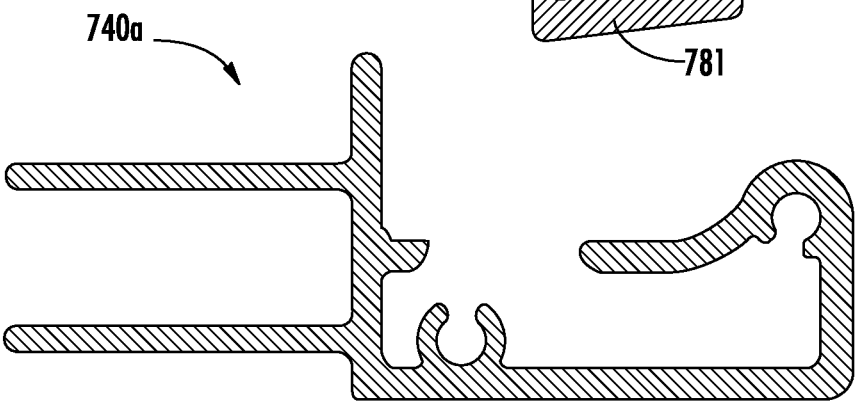
FIG. 21 is a cross-sectional view of a terminating end member according to an exemplary embodiment.

According to other exemplary embodiments, the terminating end member 740 may be configured in other manners to provide connection to a structure and/or fixed panel including, but not limited to, other angular relationships between different segments of the end members (e.g., non-perpendicular), or to couple to a hinged door panel. According to an exemplary embodiment, an alternative terminating end member 740*a* may be configured as shown in FIG. 21.

According to an exemplary embodiment, trim pieces may be provided to cover various features (e.g., attachment features) of the terminating end member 740 for more pleasing aesthetics and/or improved water shedding characteristics. For example, a first (e.g., interior) trim cover 770 may be configured to cover interior portions (i.e., visible from inside the shower enclosure 10, or through the fixed panel 30) of the terminating end member 740 from view, including, for example, the forward flange 744 and apertures 744*a* thereof. The first trim cover 770 may, for example, be a plate or sheet having a width approximately equal to the forward flange 744, such that the trim cover 770 extends generally between the first layer 310 of the side panel 300 and the fixed panel 30. The trim cover 770 may further have a thickness that is complementary to those of the first layer 310 and the forward flange 744, such that the trim cover 770 is generally flush (e.g., generally coplanar) with a forward surface of the first layer 310 of the side panel 300. The trim cover 770 may, for example, be configured to couple to the terminating end member 740 in a hidden manner (e.g., adhesives and/or hidden mechanical fasteners or features, such as a snap-fit arrangement). The first trim cover 770 may, for example, be made from a material that is opaque (e.g., to hide the terminating end member 740 and apertures 744*a*) and aesthetically pleasing (e.g., generally matching or complementary to aesthetics of the first layer 310 of the side panel 300).

According to an exemplary embodiment, a second (or exterior) trim cover 780 is configured to cover exterior portions (i.e., those visible from outside the shower enclosure 10) of the terminating end member 740 from view, including, for example, the second forward flange 749, stop member 750, and/or substrate 25. For example, the second trim cover 780 may be configured to couple to the stop member 750, for example, with a snap fit connection. More particularly, the trim cover 780 includes a forward portion 781 that is generally U-shaped with a flat forward surface and includes generally opposed protrusions 782, 783 (e.g., tabs, extensions, etc.) that are configured to be elastically spread apart for receipt into recesses (e.g., indentations, etc.) on opposite sides of the stop member 750. The trim cover 780 may further include a rearwardly projecting protrusion 784 that is configured to engage a forward surface of the stop member 750 to tightly hold the stop member 750 between the protrusion 784 and one or both of the opposed protrusions 782, 783. The trim cover 780 further includes a rearward depending flange 785 extending from the forward portion 781 at a generally perpendicular angle and which is configured to engage a forward surface of the channel 760 and be generally coplanar therewith. Configured in this manner, the forward portion 781 and rearward portion 785 of the trim cover 780 generally cover the second forward flange 749 and substrate 25 of the terminating end member 740, as well as the stop member 750, from view. The trim cover 780 is, for example, an extruded aluminum material, or may be made according to other manufacturing methods (e.g., injection molded, etc.) and/or other materials (e.g., other metals, polymers, resins, etc.) as may be aesthetically desirable (e.g., to match the exposed surface of channel 760).

Figure 19:
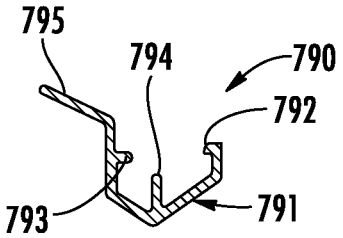
FIG. 19 is a cross-sectional view of a trim cover according to an exemplary embodiment.

According to another exemplary embodiment, as shown in FIG. 19, a trim cover 790 may be used instead of trim cover 780 and includes a forward portion 791 that is generally U-shaped with an angled forward surface. The trim cover 790 further includes protrusions 792, 793, 794 that are configured to engage the stop member 750 (in similar manner to the protrusions 782, 783, 784 of trim cover 780). The trim cover 790 further includes a rearward depending flange 795 extending from the forward portion 791 at a non-normal angle and is configured to engage a forward surface of the channel 760 at a non-normal angle.

Figure 17A:
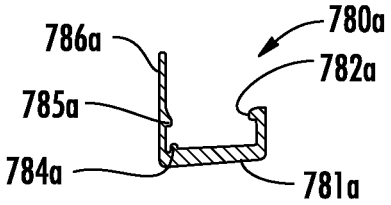
FIG. 17*a* is a cross-sectional view of a trim cover according to an exemplary embodiment.
Figure 17B:
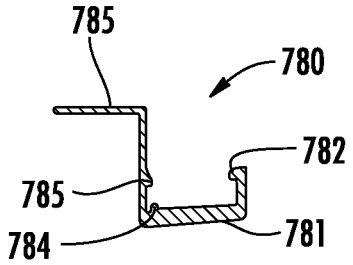
FIG. 17*b* is a cross-sectional view of a trim cover according to the exemplary embodiment shown in FIG. 13.

According to other exemplary embodiments, drywall 1, other paneling, or surface (e.g., tile, etc.) of the home or structure may cover and/or be installed after channel 760. In such instances, an alternative trim cover 780*a* (as shown in FIG. 17*a*) may be utilized. The trim cover 780*a* is configured substantially similar to trim cover 780 but omits the rearward depending flange 785. Instead, the drywall 1, or other surface, abuts an outer surface of a leg 786*a* of the trim cover 780*a*.

According to an exemplary embodiment, one or more terminating end members 740, or portions thereof, may not receive or be coupled to a fixed panel 30. For example, a first side panel 300 may include a terminating end member 740 that is coupled to a fixed panel 30, while a second side panel 400, that is disposed generally opposite the first side panel 300, includes a similarly configured end member 740 but which is not coupled to a fixed panel 30. Or, for example, a fixed panel 30 may extend only part way up the height of the terminating end member 740. In such instances, modified versions of the previously discussed trim pieces may be provided and/or additional trim pieces may be provided to cover and/or fill the recess into which the fixed panel 30 might otherwise be positioned. For example, a wider trim piece 760 may be configured to extend generally between the trim piece 780 (or alternatives) and a first layer 310 of the panel 300. Alternative trim pieces 780, 780*a*, or 790 may be configured to extend further past the stop member 750 so as to cover the void. Further, an additional trim piece (e.g., square, rectangular, or flat or U-shaped profile) may be provided to fill the void.

Figure 14:
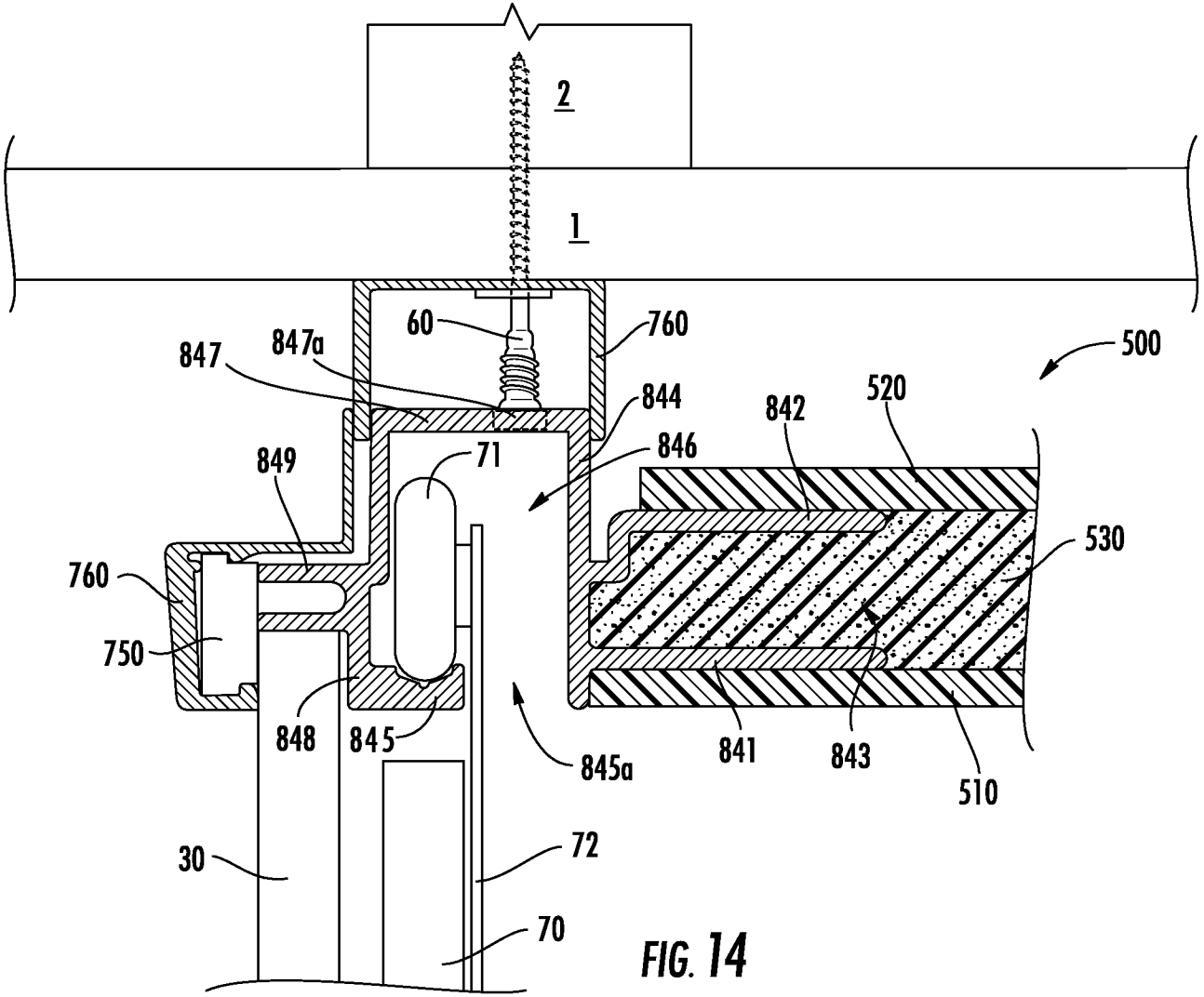
FIG. 14 is a magnified, cross-sectional view of a ceiling panel and forward end member of the shower enclosure from FIG. 3.
Figure 15:
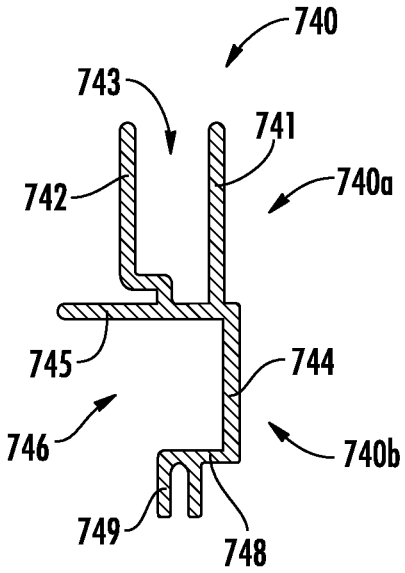
FIG. 15 is a cross-sectional view of a terminating end member according to the exemplary embodiment shown in FIG. 13.
Figure 16:
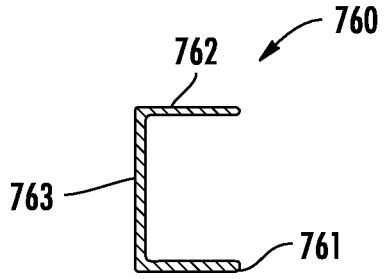
FIG. 16 is a cross-sectional view of a wall channel according to the exemplary embodiment shown in FIG. 13.
Figure 18:
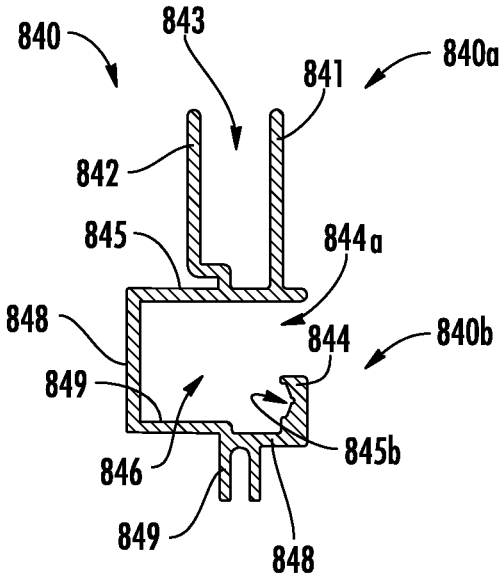
FIG. 18 is a cross-sectional view of a forward ceiling end member according to the exemplary embodiment shown in FIG. 14.

Referring to FIGS. 14 and 18, according to an exemplary embodiment, the ceiling panel 500 further includes a forward ceiling end member 840. The forward ceiling end member 840 includes a first side 840*a* that is configured to couple to the ceiling panel 500 as described previously. At its second side 840*b*, the forward ceiling end member 840 is configured to couple to the fixed panel 30 and/or operably couple to a movable panel or door 70.

According to an exemplary, at its second side 840*b*, the forward ceiling end member 840 includes a generally G-shaped cavity 846 that is defined generally by a rear (e.g., upwardly extending) flange 845 (e.g., segment, member, etc.), an upper (e.g., outwardly extending) flange 847 (e.g., segment, member, etc.), a forward (e.g., downwardly extending) flange 847, and a lower (e.g., inwardly extending) flange 844. The rear flange 845 interconnects the first segment 841 and 842 of the end member 840 at a spaced apart distance, so as to define the cavity 843 therebetween (e.g., to receive the third layer 530 of the ceiling panel 500 therebetween). The upper flange 847 extends forward from the rear flange 845 at a generally perpendicular angle, the forward flange 847 extends downward from the upper flange 847 at a generally perpendicular angle, and the lower flange 845 extends inward from the forward flange 847 at a generally perpendicular angle at a height generally opposite the bottom end of the upwardly extending flange 845. The lower flange 844 is spaced apart from the rear flange 845 to define a gap 844*a* (e.g., space) therebetween, for example, for the movable panel 70 to slide therein.

According to an exemplary embodiment, the forward ceiling end member 840 is configured to couple to a structure (e.g., drywall, paneling, or decorative structural surface 1 and/or ceiling joist 2). The upper flange 847 may include apertures 847*a* that are configured to receive a fastener 60, therein, a head of which engages a surface (e.g., lower) of the upper flange 847. According to other exemplary embodiments, a substrate (e.g., similar to substrate 25) may be coupled to an upper surface of the upper flange 847 (e.g., with adhesives and/or mechanical fasteners), which is then coupled to the structure (e.g., ceiling joist 2) with the threaded fastener 60. The threaded fastener 60 may be configured to adjust for level (e.g., similar to the fastener 60 described above as adjusting for plumb), or conventional means may be used, such as shims described above.

According to an exemplary embodiment, a ceiling channel 760, configured similarly to the wall channel described above, may also be provided. For example, the ceiling channel 760 is configured to provide improved aesthetics and/or additional structural rigidity to the shower enclosure 10. The ceiling channel includes generally parallel flanges 761, 762 that are spaced apart by a generally straight, flat interconnecting flange 763. The parallel flanges are configured to receive a portion of the forwarding ceiling end member 840 therein and, in particular, are configured to engage or be adjacent to upper portions of a rear surface of the rear flange 845 and a forward surface of the forward flange 848. The forward flange 61 is thereby configured to cover a uneven gap between the drywall 1 and end member 840, which may arise due to a non-straight or unlevel ceiling (e.g., drywall 1).

According to an exemplary embodiment, the forward ceiling end member 840 is configured to couple to the fixed panel 30 in substantially the same manner as the terminating end member 740 (e.g., through use of a adhesives, stop member 750, and trim cover 780, 780*a*, 790) along an upper edge or end of the fixed panel 30. Similarly, for ceiling end members 840, or portions thereof, where a fixed panel 30 is not positioned, alternative formations of trim pieces 780, 780*a*, and 790 and/or additional trim pieces (as for the terminating end member 740) may be provided to cover and/or fill the void where the fixed panel 30 might otherwise be positioned, for example, by extending to and/or covering flange 845.

According to an exemplary embodiment, the forward ceiling end member 840 is further configured to operably couple to a moveable (e.g., sliding) panel 70. For example, the lower flange 845 defines a channel 845*b* (e.g., recess, etc.) configured to receive a slider 71 (e.g., roller, wheel, etc.) of the movable panel 70 therein. The gap 845*a* is configured sufficient width to receive the slider 71 and connecting member 72 (which connects the slider 71 to the movable panel 70) therein, such that the slider 71 may lifted into the cavity 846 and placed into the channel 845*b*. Furthermore, the height of the cavity 846 is also configured to provide sufficient clearance for the slider 71 to be received therein (e.g., vertical clearance to be moved laterally over a lip of the channel 845*b* to be placed therein) and move therein (e.g., slide, roll, etc.) after placement. Configured in this manner, the forward ceiling end member 840 provides support for the movable panel 70 to be positioned in and slide within a plane that is generally parallel with the fixed panel 30 and/or generally perpendicular to side panel 300 and/or side panel 400. According to an exemplary embodiment, the movable panel 70 may comprise a glass material, or any other material with suitable water shedding and appealing aesthetics (e.g., the same material as fixed panel 30, or otherwise complementary to interior panels 100, 200, etc.).

Figure 22:
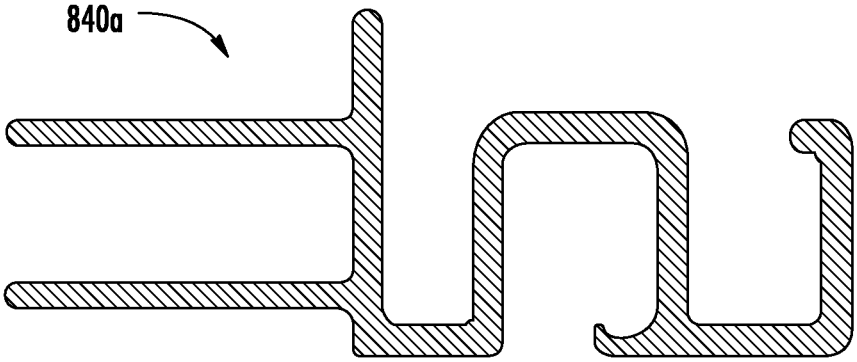
FIG. 22 is a cross-sectional view of a forward ceiling end member according to an exemplary embodiment.

According to other exemplary embodiments, the forward ceiling end member may be configured in other manners including, for example, for sealing with a hinged door or as the alternative forward ceiling end member 840*a* shown in FIG. 22.

Figure 20:
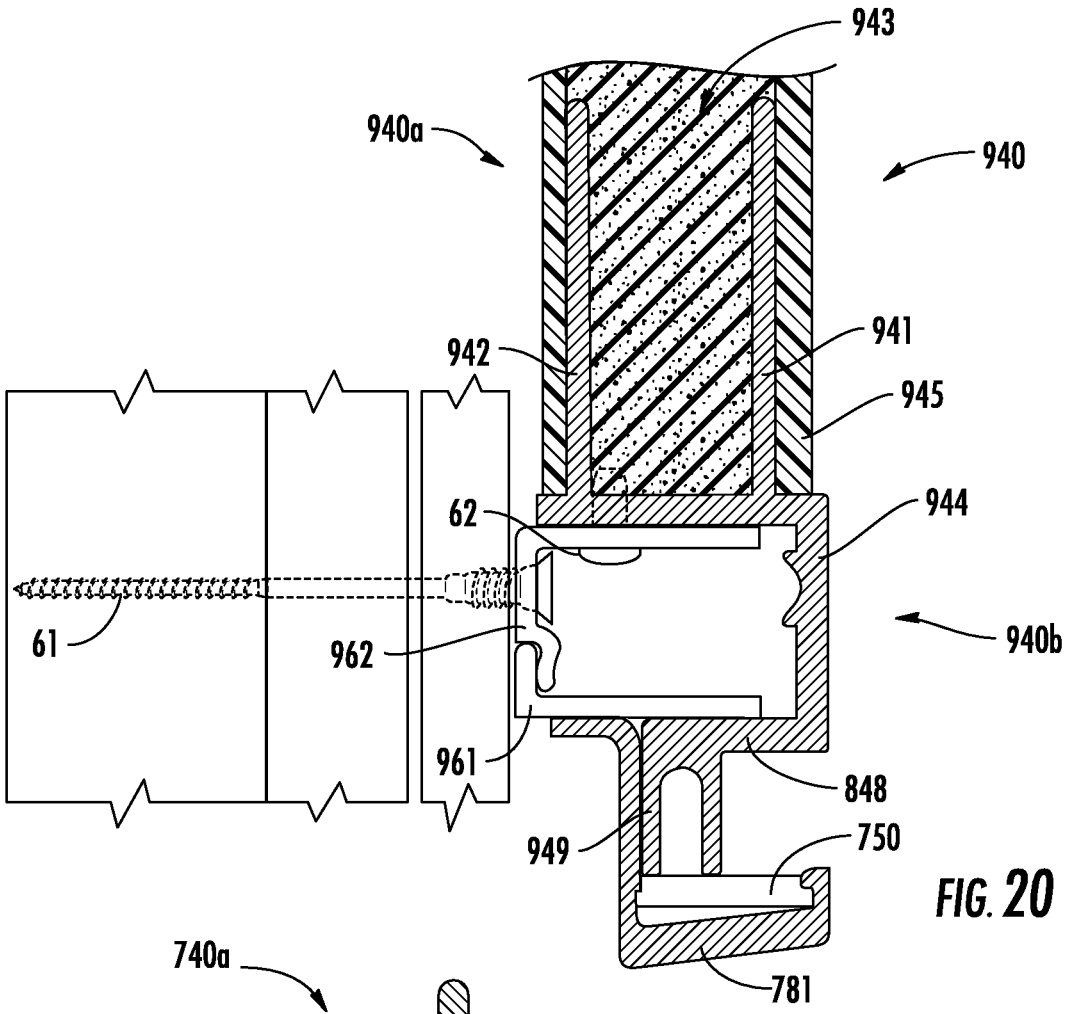
FIG. 20 is a cross-sectional view of a wall or ceiling end member according to an exemplary embodiment.

According to an exemplary embodiment, a terminating end member and/or forward ceiling end member may be configured to mount or couple to a structure (e.g., wall stud 2 or ceiling joist 2) in another manner. Referring to FIG. 20, for example, an end member 940 may include a first end 940*a* configured to couple to a wall or ceiling panel (e.g., respective layers thereof) as described previously. At its second end, the end member 940 is configured to couple to a fixed panel as described previously (e.g., with flanges 948, 949 configured similar to flanges 748, 848 and 749, 849, respectively of end members 740 and 840, with stop member 750, and or trim covers 780, 780*a*, etc.). However, instead of being coupled directly to a structure (e.g., wall stud 2 or joist 2) directly with a fastener 60 or indirectly with a substrate 25 and fastener 60, a generally L-shaped member or extrusion 962 is coupled at a first flange directly to the structure with a fastener 61 (e.g., nail, screw, etc.). At a second flange, depending generally perpendicular to the first flange, the member 962 is coupled to a rearward depending flange 945 of the end member 940 with a fastener 62 (e.g., screw), which may be moved relative to the member 962 (e.g., through elongated aperture) and/or end member 940 so as to adjust for plumb or level. The L-shaped member 962 may further include a lip disposed generally opposite the second flange that is configured to receive a flange of a generally L-shaped trim cover 961 thereunder (e.g., elastically to be pressed between drywall, tile, stud or other structure and the lip of the L-shaped member 962), a second flange of which depends generally perpendicular therefrom to cover an gap between the forward flange 949 of the end member 940 and the structure. A trim cover 780 may engage the second flange of the trim cover 961.

According to an exemplary embodiment, the panels (e.g., 100 to 500) and/or end members (e.g., 100 to 600) may be configured in various additional manners including, for example, to mount accessories and to aid and/or provide greater flexibility in plumbing installation. For example, the corner end members 300, 400 and/or intermediate end members 100, 200 may be configured to mount accessories (e.g., baskets, shelves, hooks, grab bars, etc.) thereon. For example, each accessory may include male members that are configured to be inserted into the gaps (e.g., 50) formed between the respective members (i.e., where a gasket (e.g., 20) might otherwise be positioned). The male members may be configured to positively engage the recesses (e.g., 147, 247, etc.), tightly fit between end members, or otherwise be configured for coupling (e.g., releasably coupling, without fasteners) to the end members. For example, a vertical grab or accessory bar may be coupled to an intermediate or corner joint, so as to at least partially obscure a user's view of the joint and provide a structure to which accessories may be mounted (i.e., being indirectly mounted to the end members).

Figure 23:
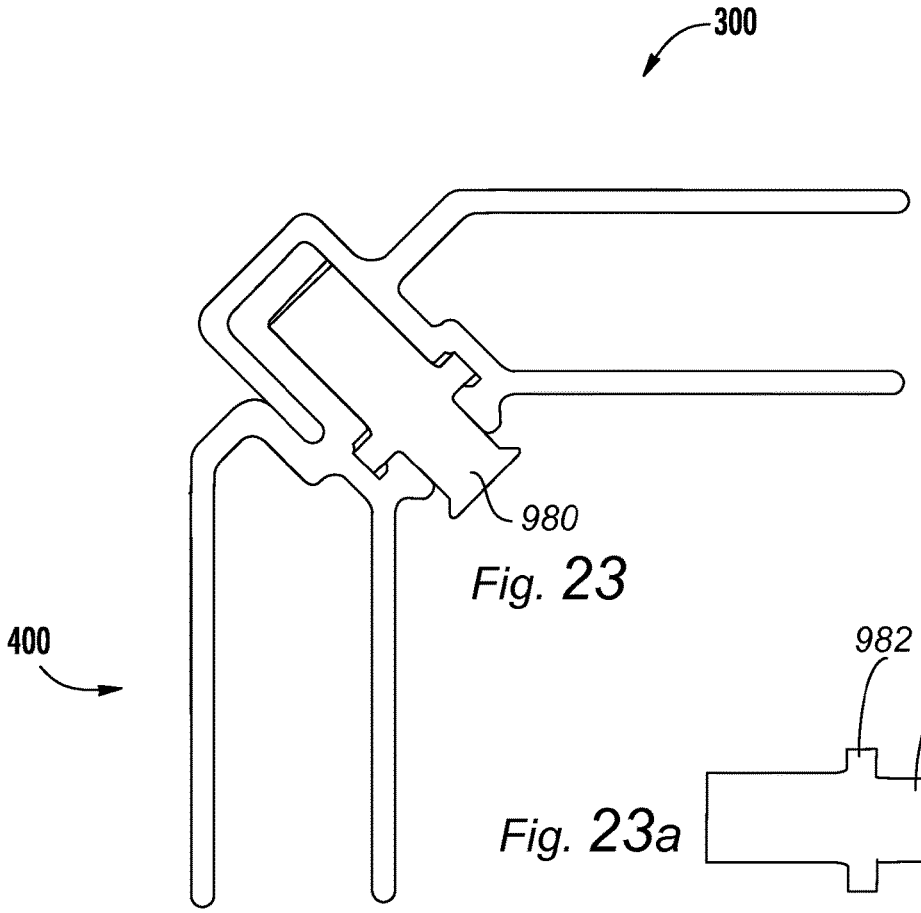
FIG. 23 is a magnified, cross-sectional view of two intersecting wall panels at a corner of the shower enclosure from FIG. 2 having a mounting coupled thereto.
Figure 23A:
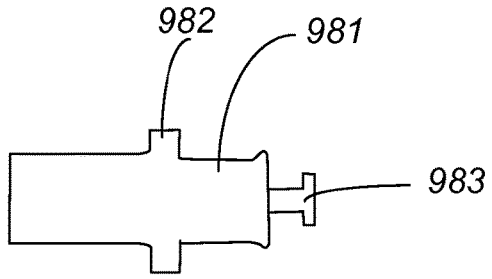
FIG. 23*a* is a top view of the mounting depicted in FIG. 23.
Figure 23B:
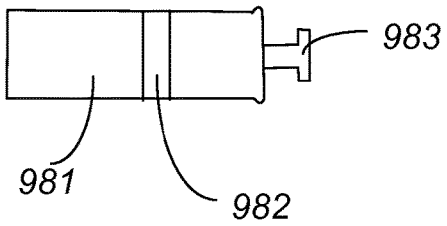
FIG. 23*b* is a side view of the mounting depicted in FIG. 23.

For example, as shown in FIGS. 23-23B, an accessory may be mounted or otherwise coupled to the enclosure using a mounting 980 (e.g., mounting member, anchor, etc.). The mounting 980 includes an elongated portion 981 having a cylindrical or other cross-sectional profile having dimensions (e.g., diameter) allowing it to be inserted into the gap 50 between the corner end members 300, 400 (or other end members as described above). Flanges 982 (e.g., wings, protrusions) extend outward from the elongated portion 981 in opposite directions and are configured to be inserted into the channels (e.g., 347, 447) of the end members 300, 400 in which a protrusions of a gasket (e.g., 20) might otherwise be positioned. The flanges 982 have a width (i.e., measured perpendicular to both the axial and radial direction of the elongated portion 981) that allows the mounting 980 to be inserted into the gap 50, and may also have a rounded, or tapered profile, that allows the mounting to be rotated for the flanges 982 to be positioned (e.g., by sliding) into the channels of the end members 300, 400. The thickness of the flanges 982 may be configured to tightly interfit the channels of the end members 300, 400 in an axial direction (i.e., relative to the elongated portion 981). A distance between the ends of the flanges 982 may be configured relative to a distance between the channels of the two end members 300, 400, so as to press against the end members 300, 400 as the mounting 980 is twisted into position with the flanges 982 in the channels of the end members. In these manners, the mounting 980 may be tightly coupled or secured to the end members 300, 400 without forming any holes in the members, panels, or other components of the enclosure that might otherwise provide a way for water to escape the enclosure. Further, in these manners, the mounting 980 may also provide for a tighter or otherwise improved connection between end members (e.g., the mounting 980 functioning similar to a set screw between the two end members). To rotate the mounting 980 into position, the mounting 980 may include a hexagonal female recess (not shown) axially aligned with the elongated portion 981 that is configured to receive an Allen wrench. The mounting 980 may also include a widened head or end (external outside of the gap 50), which may, for example, be received within a channel of an accessory for coupling the accessory to the mounting 980. Instead, or additionally, the mounting 980 may be configured to receive a threaded or other type of elongated fastener 983 therein (e.g., axially aligned with the elongated portion 981), which may be used to couple an accessory thereto.

According to an exemplary embodiment, the wall panels (e.g., 100 to 400) are configured to provide smaller rough-in openings than are conventionally required (e.g., to provide reduced escutcheon size for covering such openings) and/or may have rough-in valves and/or supplies mounted directly to the wall panel (e.g., during manufacturing to provide simplified on-site installation.

According to still further exemplary embodiments, the shower enclosure may include additional features including, for example, lighting that may be incorporated into the ceiling panel 500 or other panels, niches that may include a cutout into one of the wall panels, and/or generally an entirely closeable or sealable structure for a steam shower.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the dual gear assemblies as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A joint for a shower enclosure comprising:
a first end member comprising:
a first flange;
a rearwardly extending segment spaced apart from the first flange; and
a rearwardly open recess defined between the first flange and the rearwardly extending segment; and
a second end member comprising:
a second flange;
a forwardly extending segment spaced apart from the second flange; and
a forwardly open recess defined between the second flange and the forwardly extending segment;
wherein a gap is defined between the rearwardly extending segment and the second flange when the first end member and the second end member are coupled;
wherein the forwardly open recess is configured to receive the rearwardly extending segment; and
wherein the rearwardly open recess is configured to receive the forwardly extending segment.

2. The joint according to claim 1, wherein the first and second flanges each defines a recess configured to be engaged by a male member of an accessory that is received in the gap.

3. The joint according to claim 1, further comprising a gasket received in the gap.

4. The joint according to claim 3, wherein:
the first and second flanges each define a recess; and
the gasket defines a plurality of projections configured to be received in the recesses.

5. The joint according to claim 1, further comprising:
a first plurality of segments extending from the first flange and configured to engage a first panel of a shower enclosure; and
a second plurality of segments extending from the second flange and configured to engage a second panel of a shower enclosure.

6. The joint according to claim 5, wherein:
the first plurality of segments extend from the first flange at a 45 degree angle; and
the second plurality of segments extend from the second flange at a 45 degree angle.

7. The joint according to claim 5, wherein the second plurality of segments extend perpendicularly to the second flange.

8. The joint according to claim 7, wherein the first plurality of segments extend perpendicularly to the first flange.

9. The joint according to claim 7, wherein the first plurality of segments extend parallel to the first flange.

10. The joint according to claim 1, wherein the rearwardly extending segment is L-shaped and defines a first leg extending parallel to the first flange and a second leg extending perpendicularly from the first leg.

11. The joint according to claim 10, wherein at least a portion of the forwardly open recess defines a width the same as a length of the second leg of the rearwardly extending segment.

12. The joint according to claim 11, wherein:

the forwardly extending segment is U-shaped and defines a first leg extending parallel to the second flange, a second leg extending perpendicularly from the first leg, and a third leg extending perpendicularly from the second leg; and the width of the forwardly open recess is defined between the first and third legs of the forwardly extending segment.

13. The joint according to claim 12, wherein the second leg of the rearwardly extending segment is configured to engage the second leg of the forwardly extending segment.

14. A joint for a shower enclosure comprising:

a first end member comprising:

a first flange;

a first rearwardly extending segment extending perpendicular to the first flange;

a second rearwardly extending segment extending perpendicular to the first flange and spaced apart from the first rearwardly extending segment; and a rearwardly open recess defined between the first rearwardly extending segment and the second rearwardly extending segment; and a second end member comprising:

a second flange;

a forwardly extending segment spaced apart from the second flange; and a forwardly open recess defined between the second flange and the forwardly extending segment;

wherein a gap is defined between the second rearwardly extending segment and the second flange when the first end member and the second end member are coupled;

wherein the forwardly open recess is configured to receive the rearwardly extending segment; and wherein the rearwardly open recess is configured to receive the forwardly extending segment.

15. The joint according to claim 14, further comprising a gasket received in the gap.

16. The joint according to claim 15, wherein:

the second rearwardly extending segment and the second flange each defines a recess; and the gasket defines a plurality of projections configured to be received in the recesses.

17. The joint according to claim 14, further comprising:

a first plurality of segments extending from the first flange and configured to engage a first panel of a shower enclosure; and a second plurality of segments extending from the second flange and configured to engage a second panel of a shower enclosure.

18. The joint according to claim 17, wherein:

the first plurality of segments extend perpendicularly to the first flange; and the second plurality of segments extend perpendicularly to the second flange.

19. The joint according to claim 14, wherein the second rearwardly extending segment is L-shaped and defines a first leg extending parallel to the first rearwardly extending segment and a second leg extending perpendicularly from the first leg.

20. The joint according to claim 19, wherein at least a portion of the forwardly open recess defines a width the same as a length of the second leg of the second rearwardly extending segment.

21. The joint according to claim 20, wherein:

the forwardly extending segment is U-shaped and defines a first leg extending parallel to the second flange, a second leg extending perpendicularly from the first leg, and a third leg extending perpendicularly from the second leg; and the width of the forwardly open recess is defined between the first and third legs of the forwardly extending segment.

22. The joint according to claim 21, wherein the second leg of the second rearwardly extending segment is configured to engage the second leg of the forwardly extending segment.

* * * * *